US011366411B2

(12) United States Patent
Ishizumi et al.

(10) Patent No.: US 11,366,411 B2
(45) Date of Patent: Jun. 21, 2022

(54) IMAGE FORMING APPARATUS

(71) Applicant: CANON KABUSHIKI KAISHA, Tokyo (JP)

(72) Inventors: Keisuke Ishizumi, Hiratsuka (JP); Shohei Ishio, Tokyo (JP); Takayuki Tanaka, Tokyo (JP); Hiroomi Kojima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/365,325

(22) Filed: Mar. 26, 2019

(65) Prior Publication Data

US 2019/0302656 A1 Oct. 3, 2019

(30) Foreign Application Priority Data

Mar. 30, 2018 (JP) ..... JP2018-068245
Feb. 6, 2019 (JP) ..... JP2019-019539

(51) Int. Cl.
*G03G 15/16* (2006.01)
*G03G 15/00* (2006.01)

(52) U.S. Cl.
CPC ..... *G03G 15/1615* (2013.01); *G03G 15/161* (2013.01); *G03G 15/162* (2013.01); *G03G 15/5058* (2013.01); *G03G 2215/00059* (2013.01); *G03G 2215/1661* (2013.01)

(58) Field of Classification Search
CPC ..... G03G 15/1605; G03G 15/1615; G03G 15/161; G03G 15/162; G03G 15/5058; G03G 2215/00059; G03G 15/0131
See application file for complete search history.

(56) References Cited

U.S. PATENT DOCUMENTS 5,995,794 A * 11/1999 Osada ..... G03G 15/162 399/302
2005/0002704 A1* 1/2005 Nakamura ..... G03G 15/2064 399/341
2006/0159494 A1* 7/2006 Hirai ..... G03G 15/1685 399/303
2011/0103815 A1* 5/2011 Hanashi ..... G03G 15/5058 399/49
2011/0206399 A1* 8/2011 Fujita ..... G03G 15/50 399/49

(Continued)

FOREIGN PATENT DOCUMENTS

JP H0962118 A 3/1997
JP 2002265642 A 9/2002
JP 2007206435 A 8/2007

*Primary Examiner* — Jessica L Eley
(74) *Attorney, Agent, or Firm* — Canon U.S.A., Inc. IP Division

(57) ABSTRACT

A detection unit executes correction control of an image formation condition on a basis of a detection result of reflected light when infrared light is radiated to a test patch, which is transferred from a photosensitive drum to an intermediate transfer belt, and the intermediate transfer belt, wherein the intermediate transfer belt has a base layer which is thickest among a plurality of layers forming the intermediate transfer belt in a thickness direction of the intermediate transfer belt and to which an ion conductive agent is added, and an inner surface layer which has a light transmittance lower than that of the base layer.

16 Claims, 15 Drawing Sheets

(56) References Cited

U.S. PATENT DOCUMENTS

| | | | | |
|---|---|---|---|---|
| 2014/0178110 | A1* | 6/2014 | Yagi | G03G 15/1605 399/302 |
| 2015/0098719 | A1* | 4/2015 | Ishizumi | G03G 15/5058 399/49 |

* cited by examiner

| | INNER SURFACE LAYER | AMOUNT OF DYE ADDED TO BASE LAYER (MASS %) | LIGHT TRANSMITTANCE (%) WHEN WAVELENGTH IS 800 nm |
|---|---|---|---|
| EXEMPLARY EMBODIMENT 1 | INCLUDE | 0.1 | 2.0 |
| COMPARATIVE EXAMPLE 1 | NOT INCLUDE | 0.1 | 12.0 |

IMAGE FORMING APPARATUS

BACKGROUND

Field of the Disclosure

The present disclosure relates to an electrophotographic image forming apparatus such as a copier or a printer.

Description of the Related Art

As an electrophotographic image forming apparatus, a tandem-type image forming apparatus that has a configuration in which a plurality of image forming units are arranged in a movement direction of a belt such as a conveyance belt or an intermediate transfer belt is known. Each of the image forming units for respective colors includes a photosensitive member (hereinafter, referred to as a photosensitive drum) of a drum shape serving as an image bearing member. Toner images of the respective colors borne by corresponding photosensitive drums of the respective colors are transferred to a transfer material, such as paper or an OHP sheet, which is conveyed by a transfer material conveyance belt, or are transferred to the transfer material after being transferred to the intermediate transfer belt once, and then fixed to the transfer material by a fixing unit.

In the electrophotographic image forming apparatus, due to a change in a condition of an installation environment of the apparatus, a change of a photosensitive drum or toner over time, a temperature change in the apparatus, or the like, an image formation condition such as a position or density of an image to be formed may vary. Thus, there is a case where correction control is performed in such a manner that reflected light from a toner image (hereinafter, referred to as detection toner) for detection that is transferred from a photosensitive drum to a belt and reflected light from the belt are detected by a detection unit such as an optical sensor and the image formation condition is corrected on the basis of a result of the detection. More specifically, in such correction control, by utilizing specularly-reflected light from the belt and diffused reflected light from the detection toner, information about a position or density of the detection toner is acquired and fed back to the correction of the image formation condition such as the position or density of the image.

As the belt used for the image forming apparatus, a member obtained by adding an electronically conductive agent such as carbon or an ionically conductive agent (hereinafter, referred to as an ion conductive agent) such as ionically conductive polymer to base resin as a substrate of the belt to adjust an electrical resistance value is widely known. Here, since the belt obtained by adding the ion conductive agent has high transparency, light from a light source is transmitted through the belt, so that erroneous detection by the detection unit may be caused when the correction control described above is performed. Against such a problem, Japanese Patent Laid-Open No. 2002-265642 discloses a configuration of a belt whose light transmittance is able to be appropriately controlled by adding a coloring agent.

In the configuration of Japanese Patent Laid-Open No. 2002-265642, however, since a dispersed state of the coloring agent affects distribution of resistance of the belt, when uniformity of an electrical resistance value of the belt is deteriorated, it may be difficult to ensure stable transferability.

SUMMARY

Thus, in the subject disclosure, an image forming apparatus that detects reflected light of light radiated to a belt and performs correction control related to an image, erroneous detection in the correction control is suppressed while stable transferability is ensured.

The disclosure provides an image forming apparatus including: an image bearing member configured to bear a toner image; a movable belt that is configured of a plurality of layers and contacts the image bearing member; a detection unit configured to detect reflected light from the belt and a detection toner image when light is radiated to the detection toner image, which is transferred from the image bearing member to the belt, and the belt; and a control unit configured to execute, on a basis of a detection result of the detection unit, correction control of an image formation condition of an image formed by the toner image, in which the plurality of layers of the belt include a first layer that has a first light transmittance and is a thickest layer out of the plurality of layers making up the belt with respect to a thickness direction of the belt and to which an ion conductive agent is added, and a second layer which has a second light transmittance lower than the first light transmittance.

Further features of the present disclosure will become apparent from the following description of exemplary embodiments with reference to the attached drawings.

DESCRIPTION OF THE EMBODIMENTS

Desirable exemplary embodiments of the disclosure will be exemplarily described in detail below with reference to the drawings. Note that, dimensions, materials, shapes, and relative arrangement of components described in the following exemplary embodiments are to be appropriately changed in accordance with a configuration of an apparatus to which the disclosure is applied and various conditions. Thus, a scope of the disclosure is not intended to be limited only to the following exemplary embodiments, unless otherwise specifically stated.

Exemplary Embodiment 1

[Explanation of Image Forming Apparatus]

Figure 1:
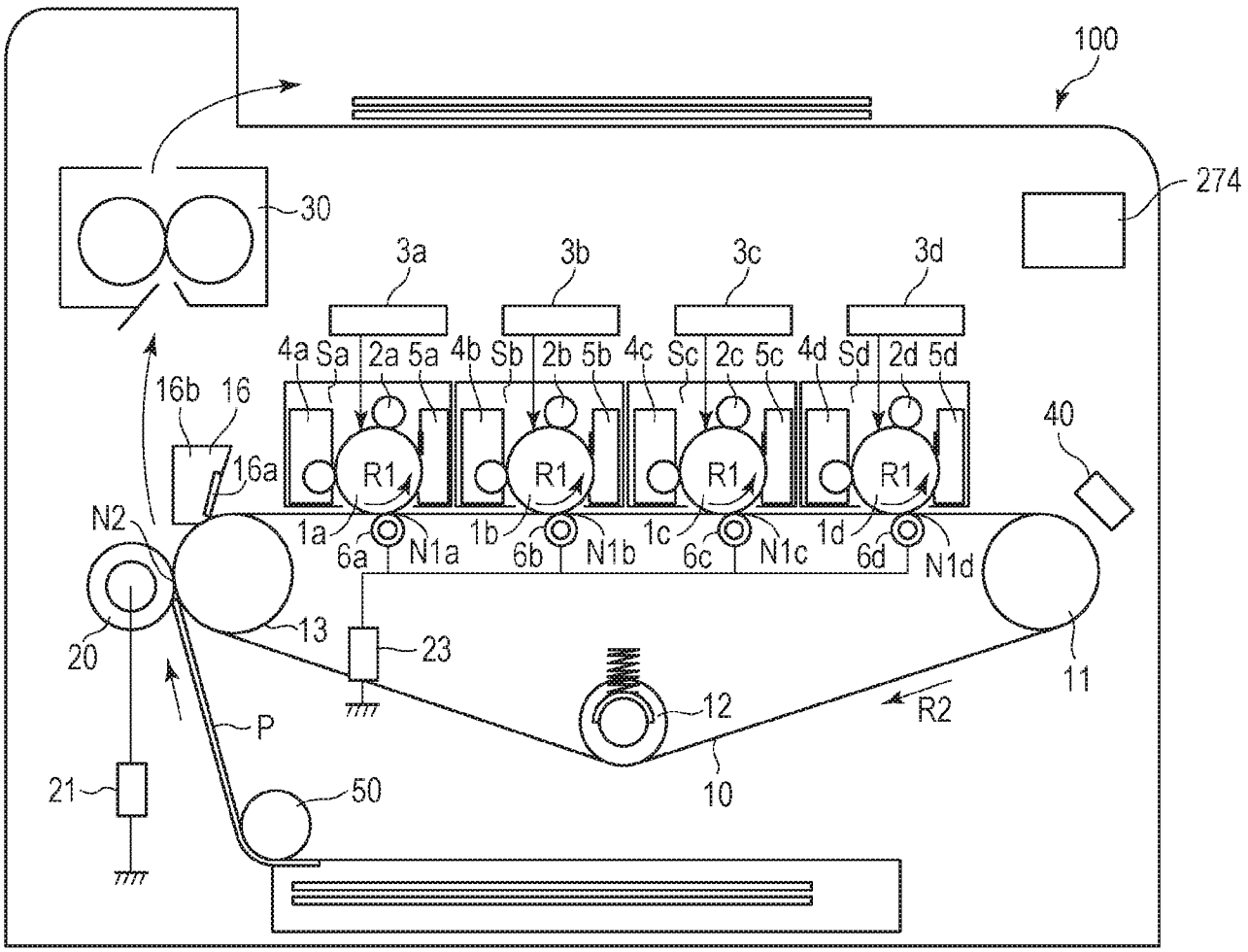
FIG. 1 is a schematic sectional view of a configuration of an image forming apparatus, according to one or more embodiment of the subject disclosure.

FIG. 1 is a schematic sectional view illustrating a configuration of an image forming apparatus 100 of the present exemplary embodiment. Note that, the image forming apparatus 100 of the present exemplary embodiment is a so-called tandem-type image forming apparatus including a plurality of image forming units Sa to Sd. The first image forming unit Sa, the second image forming unit Sb, the third image forming unit Sc. and the fourth image forming unit Sd form images with toner of colors of yellow (Y), magenta (M), cyan (C), and black (Bk), respectively. The four image forming units are arranged in a row with a certain interval, and configurations of the image forming units are practically common to each other in many parts except for colors of the toner contained therein. Accordingly, the image forming apparatus 100 of the present exemplary embodiment will be described below with reference to the first image forming unit Sa.

The first image forming unit Sa includes a photosensitive drum 1*a* serving as a photosensitive member of a drum shape, a charging roller 2*a* serving as a charging member, a development unit 4*a*, and a drum cleaning unit 5*a*.

The photosensitive drum 1*a* is an image bearing member that bears a toner image and rotationally driven in a direction indicated by an arrow R1 in FIG. 1 at a predetermined circumferential speed (process speed). The development unit 4*a* contains yellow toner, and develops a yellow toner image on the photosensitive drum 1*a*. The drum cleaning unit 5*a* is a unit that collects toner bonded to the photosensitive drum 1*a*. The drum cleaning unit 5*a* includes a cleaning blade that contacts the photosensitive drum 1*a* and a waste toner box that contains, for example, toner removed from the photosensitive drum 1*a* by the cleaning blade.

When an image forming operation starts upon reception of an image signal by a controller 274 (illustrated in FIG. 2) as a control unit, the photosensitive drum 1*a* is rotationally driven. In the course of rotation, the photosensitive drum 1*a* is uniformly charged with a predetermined potential (charging potential) in a predetermined polarity (in the present exemplary embodiment, a negative polarity) by the charging roller 2*a*, and exposed to light according to the image signal by the exposure unit 3*a*. Thereby, an electrostatic latent image corresponding to a yellow color component image of a target color image is formed. Then, the electrostatic latent image is developed by the development unit 4*a* at a development position and visualized as a yellow toner image (hereinafter, simply referred to as a toner image). Here, a regular charging polarity of the toner contained in the development unit 4*a* is a negative polarity. In the present exemplary embodiment, the electrostatic latent image is reversely developed with toner charged in a polarity that is the same as the charging polarity of the photosensitive drum 1*a* charged by the charging member, however, the disclosure is also applicable to an image forming apparatus that positively develops the electrostatic latent image with toner charged in a polarity opposite to the charging polarity of the photosensitive drum 1*a*.

An intermediate transfer belt 10 as an intermediate transfer body that is endless and movable is arranged at a position contacting photosensitive drums 1*a* to 1*d* of the image forming units Sa to Sd and is stretched around three rollers, i.e., a support roller 11, a stretching roller 12, and a facing roller 13 that are stretching members. The intermediate transfer belt 10 is an endless belt made of a resin material to which electrical conductivity is provided by adding a conductive agent and which has a circumferential length of 700 mm, and is stretched with a tensile force of a total pressure of 60 N applied by the stretching roller 12 and moves in a direction indicated by an arrow R2 in FIG. 1 due to rotation of the facing roller 13 that rotates by receiving a driving force. Note that, the intermediate transfer belt 10 in the present exemplary embodiment is constituted by a plurality of layers, and details thereof will be described below.

In the present exemplary embodiment, a sleeve made of stainless steel (SUS) is used as the support roller 11 and the stretching roller 12 and outer diameters of the support roller 11 and the stretching roller 12 are respectively 24 mm and 12 mm. As the facing roller 13, a roller that is obtained by covering a sleeve made of stainless steel (SUS) having an outer diameter of 23 mm with ethylene propylene diene rubber (EPDM) having a thickness of 500 μm and that is adjusted to have an electrical resistance value of $1\times10^5\Omega$ or less is used. Note that, as in the present exemplary embodiment, when a roller made of a metal member that is not covered with a rubber member is used as the support roller 11 and the stretching roller 12, it is possible to achieve cost reduction of a member.

The toner image formed on the photosensitive drum 1*a* is primarily-transferred to the intermediate transfer belt 10 upon application of a voltage with a positive polarity from a primary transfer power source 23 to a primary transfer roller 6*a* while the toner image passes through a primary transfer portion N1*a* at which the photosensitive drum 1*a* contacts the intermediate transfer belt 10. After that, toner that is not primarily-transferred to the intermediate transfer belt 10 and remains on the photosensitive drum 1*a* is collected by the drum cleaning unit 5*a* and thereby removed from a surface of the photosensitive drum 1*a*.

Here, the primary transfer roller 6*a* is a primary transfer member (contact member) that is provided at a position corresponding to the photosensitive drum 1*a* via the intermediate transfer belt 10 and contacts an inner circumferential surface of the intermediate transfer belt 10. The primary transfer power source 23 is a power source that is able to apply a voltage with a positive polarity or a negative polarity to primary transfer rollers 6*a* to 6*d*. A configuration in which the common primary transfer power source 23 applies the voltage to a plurality of primary transfer members will be described in the present exemplary embodiment, but the disclosure is not limited thereto and is also applicable to a configuration in which a plurality of primary transfer power sources are provided correspondingly to the respective primary transfer members.

Subsequently, in a similar manner, a magenta toner image of a second color, a cyan toner image of a third color, and a black toner image of a fourth color are formed and sequentially overlapped and transferred to the intermediate transfer belt 10. Thereby, the toner images of the four colors corresponding to a target color image are formed on the intermediate transfer belt 10. Then, the toner images of the four colors borne by the intermediate transfer belt 10 are collectively secondarily-transferred to a surface of a transfer material P, such as paper or an OHP sheet, which is fed by a feeding unit 50, while passing through a secondary transfer portion formed by a secondary transfer roller 20 and the intermediate transfer belt 10 contacting with each other.

The secondary transfer roller 20 has an outer diameter of 18 mm and is obtained by covering a nickel plated steel bar having an outer diameter of 6 mm with a foamed sponge body that is mainly made of NBR and epichlorohydrin rubber and is adjusted to have a volume resistivity of $10^8$ Ω·cm and a thickness of 6 mm. Note that, the formed sponge body has a rubber hardness of 30° when measurement is executed by using an Asker-C hardness meter at a weight of 500 g. The secondary transfer roller 20 is in contact with an outer circumferential surface of the intermediate transfer belt 10, and is pressed against the facing roller 13, which is arranged at a position facing the secondary transfer roller 20 via the intermediate transfer belt 10, at a pressure force of 50 N to form a secondary transfer portion N2.

The secondary transfer roller 20 is driven to rotate along with the intermediate transfer belt 10, and when a voltage is applied thereto from a secondary transfer power source 21, a current flows to the facing roller 13 from the secondary transfer roller 20. Thereby, the toner image borne by the intermediate transfer belt 10 is secondarily-transferred to the transfer material P at the secondary transfer portion N2. Note that, when the toner image on the intermediate transfer belt 10 is secondarily-transferred to the transfer material P, the voltage applied to the secondary transfer roller 20 from the secondary transfer power source 21 is controlled so that the current flowing to the facing roller 13 from the secondary transfer roller 20 via the intermediate transfer belt 10 becomes constant. In addition, an amount of the current for performing the secondary transfer is decided in advance in accordance with a surrounding environment in which the image forming apparatus 100 is installed or a type of the transfer material P. The secondary transfer power source 21 is connected to the secondary transfer roller 20 and applies a transfer voltage to the secondary transfer roller 20. Further, the secondary transfer power source 21 is able to output the voltage in a range from 100 V to 4000 V.

Then, the transfer material P to which the toner images of the four colors are transferred through the secondary transfer is heated and pressurized by a fixing unit 30, so that the toner of the four colors is fused and mixed and fixed to the transfer material P. The toner remaining on the intermediate transfer belt 10 after the secondary transfer is cleaned and removed by a belt cleaning unit 16 that is provided so as to face the facing roller 13 via the intermediate transfer belt 10. The belt cleaning unit 16 includes a cleaning blade 16*a* (cleaning member) that contacts the outer circumferential surface of the intermediate transfer belt 10 at a position where the belt cleaning unit 16 faces the facing roller 13 and a residual toner container 16*b* that contains the toner collected by the cleaning blade 16*a*.

Through the operation described above, the image forming apparatus 100 of the present exemplary embodiment forms a full-color printed image.

[Explanation of Control Block Diagram]

Figure 2:
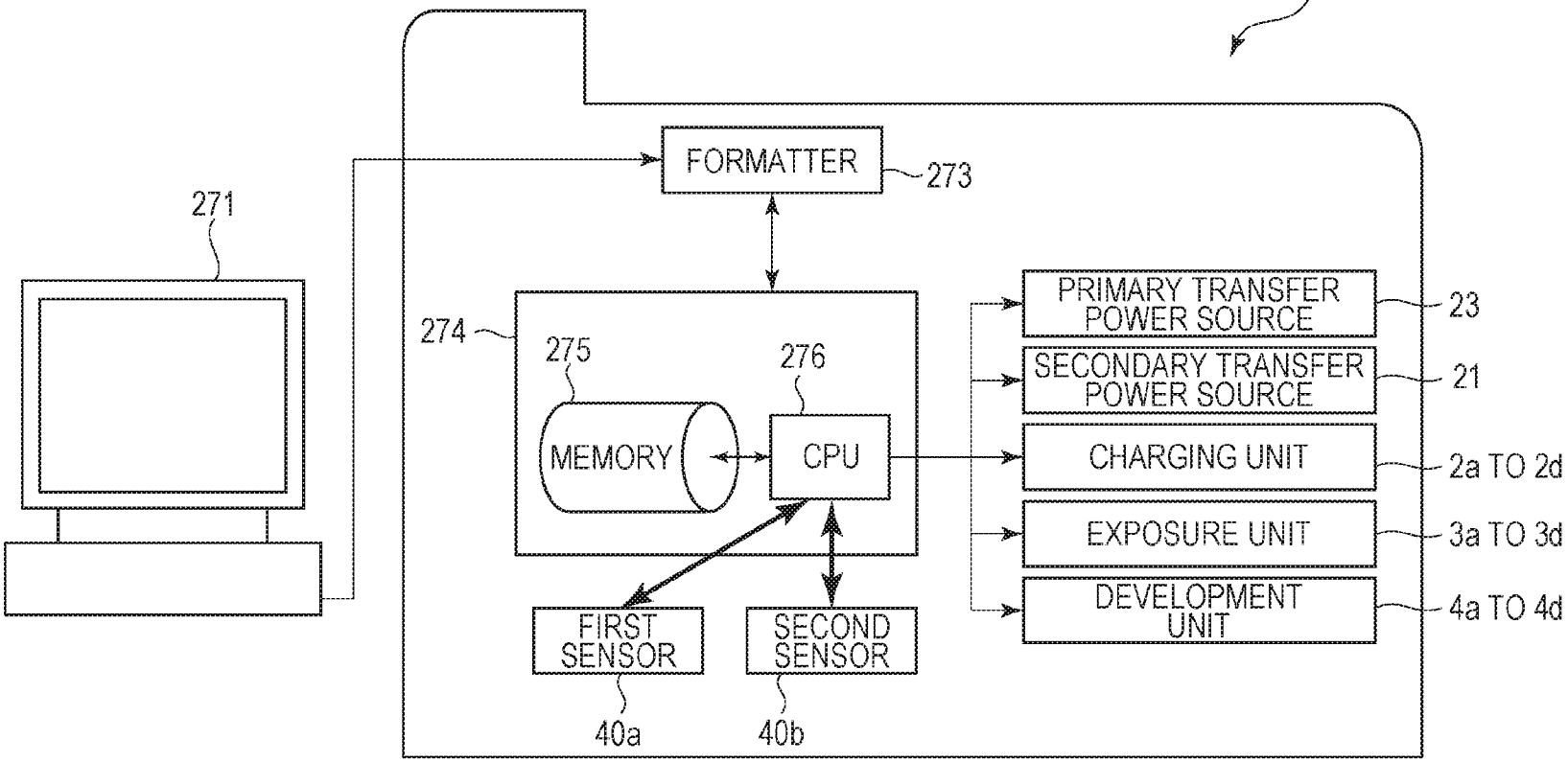
FIG. 2 is a control block diagram of an image forming apparatus, according to one embodiment of the subject disclosure.

FIG. 2 is a control block diagram illustrating control of the image forming operation in the image forming apparatus 100. A personal computer 271 as a host device issues an instruction to start image formation to a formatter 273 in the image forming apparatus 100 and transmits data of an image to be formed to the formatter 273. The formatter 273 converts the image data transmitted from the personal computer 271 into exposure data and transfers the resultant to the controller 274 as a control unit. The controller 274 is provided with a CPU 276, a memory 275, and the like and is able to perform a preprogrammed operation. Upon reception of the instruction to start image formation from the formatter 273, the CPU 276 provided in the controller 274 controls the respective units, so that the image forming operation is performed.

The CPU 276 also performs processing of receiving signals from a first sensor 40*a* and a second sensor 40*b*, which are provided in a detection unit 40, when correction control to correct an image formation condition such as a position or density of an image to be formed in the image forming apparatus 100 is executed. In the correction control of the image formation condition, a quantity of reflected light from the outer circumferential surface of the intermediate transfer belt 10 at a position facing the detection unit 40 or a test patch (detection toner image) formed on the intermediate transfer belt 10 is measured. The detection signals by the first sensor 40*a* and the second sensor 40*b* are subjected to AD conversion via the CPU 276 and then stored in the memory 275. The controller 274 performs calculation by using detection results by the first sensor 40*a* and the second sensor 40*b* to perform various kinds of correction.

[Detection Unit]

Next, the detection unit 40 will be described. The detection unit 40 detects reflected light from the outer circumferential surface of the intermediate transfer belt 10 and the test patch formed on the intermediate transfer belt 10. Here, the test patch is specifically a positional deviation control pattern for detecting a deviation of a position where an image is formed or a density control pattern for detecting a density of an image.

Figure 3A:
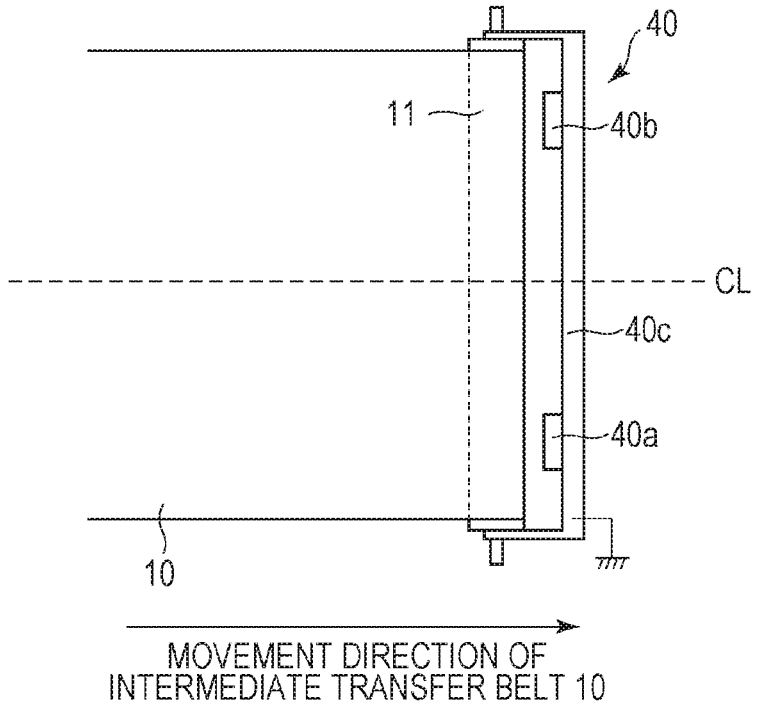
FIGS. 3A to 3C are schematic views for explaining arrangement and a configuration of a detection unit, according to one or more embodiment of the subject disclosure.
Figure 3B:
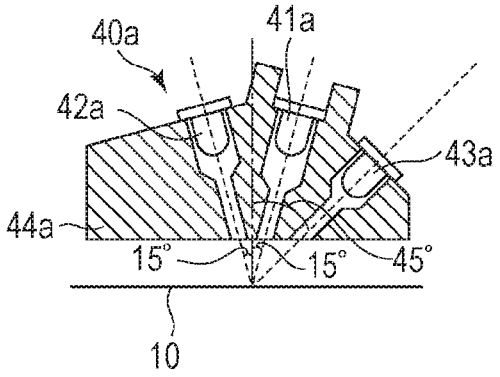
Figure 3C:
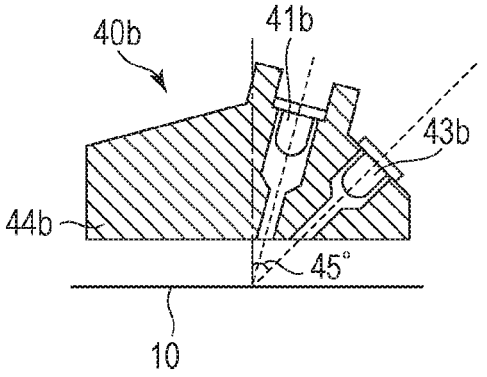

FIG. 3A is a schematic view for explaining a configuration of the detection unit 40. FIG. 3B is a schematic view for explaining a configuration of the first sensor 40*a* (first detection member) provided in the detection unit 40 and FIG. 3C is a schematic view for explaining a configuration of the second sensor 40*b* (second detection member) provided in the detection unit 40.

As illustrated in FIG. 3A, the detection unit 40 has two sensors of the first sensor 40*a* and the second sensor 40*b*, and the first sensor 40*a* and the second sensor 40*b* are held by a stay 40*c* as a holding member. The first sensor 40*a* and the second sensor 40*b* are arranged so as to be opposite to each other across a line segment CL that is a center line of the intermediate transfer belt 10 in a width direction orthogonal to a movement direction of the intermediate transfer belt 10. In the present exemplary embodiment, a distance from the line segment CL to each of the first sensor 40*a* and the second sensor 40*b* is 90 mm.

As illustrated in FIG. 3B, the first sensor 40*a* has a light emitting element 41*a* such as an LED, light receiving elements 42*a* and 43*a* such as a phototransistor, and a holder 44*a*. The light emitting element 41*a* is arranged so as to have an inclination of 15° with respect to the intermediate transfer belt 10 and radiates infrared light (for example, with a wavelength of 800 nm) to the test patch on the intermediate transfer belt 10 and the surface of the intermediate transfer belt 10. A region where the infrared light is radiated is a detection region, and a shape of the holder 44*a* is adjusted so that a spot diameter when the infrared light is radiated from the light emitting element 41*a* to the intermediate transfer belt 10 is 2 mm.

The light receiving element 43*a* is arranged so as to have an inclination of 45° with respect to the intermediate transfer belt 10 and receives the infrared light diffused and reflected by the test patch and the surface of the intermediate transfer belt 10. The light receiving element 42*a* is arranged so as to have an inclination of 15° with respect to the intermediate transfer belt 10 and receives specularly-reflected light and diffused reflected light of the infrared light, which are obtained from the test patch and the surface of the intermediate transfer belt 10. With the first sensor 40*a*, the test patch of the positional deviation control pattern, the density control pattern, or the like is able to be detected.

As illustrated in FIG. 3C, the second sensor 40*b* has a light emitting element 41*b* such as an LED, a light receiving element 43*b* such as a phototransistor, and a holder 44*b*. The light emitting element 41*b* is arranged so as to have an inclination of 15° with respect to the intermediate transfer belt 10 and has the same characteristic of an element as that of the light emitting element 41*a*. The light receiving element 43*b* is arranged so as to have an inclination of 45° with respect to the intermediate transfer belt 10 and has the same characteristic of an element as that of the light receiving element 43*a*. With the second sensor 40*b*, the test patch of the positional deviation control pattern is able to be detected.

[Explanation of Correction Control of Image Formation Condition]

Figure 4:
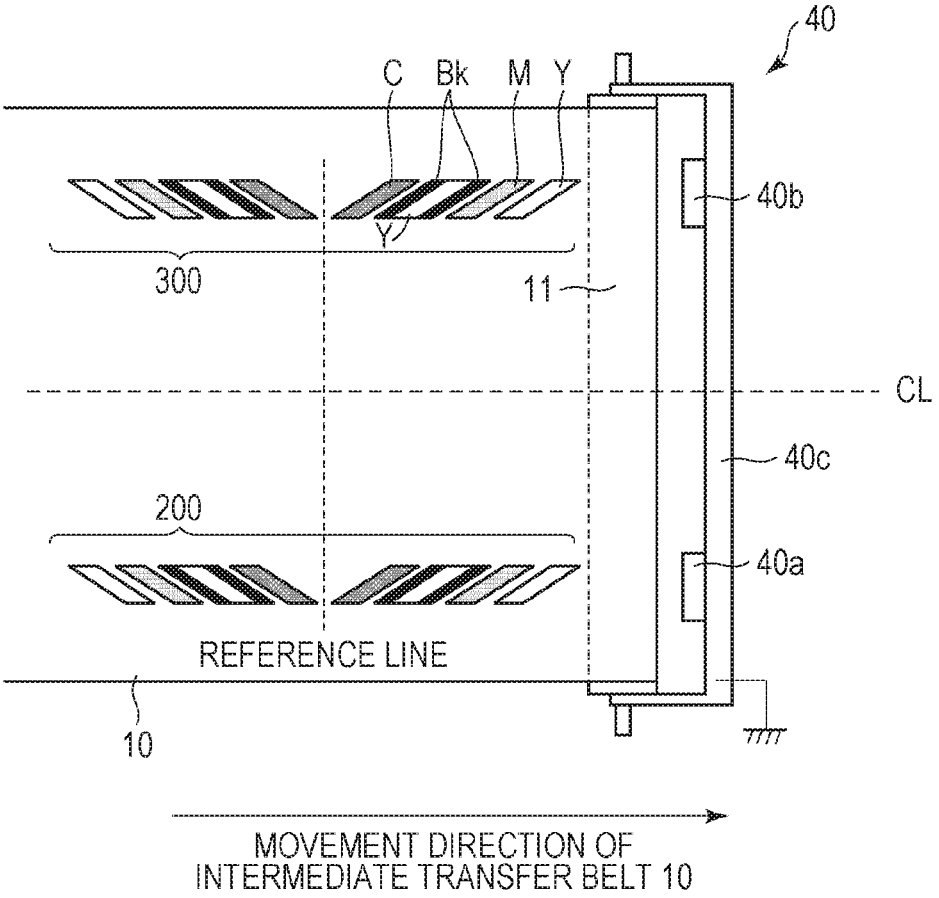
FIG. 4 is a schematic view of a detection toner image when correction control to correct a position of an image is executed, according to one or more embodiment of the subject disclosure.

FIG. 4 is a schematic view for explaining a positional relationship between a test patch, which is formed on the intermediate transfer belt 10 when correction control (hereinafter, referred to as registration correction) to correct a position of an image is executed, and the first sensor 40*a* or the second sensor 40*b* in the present exemplary embodiment. As illustrated in FIG. 4, when the registration correction is performed, test patches 200 and 300 of the positional deviation control pattern are respectively formed at positions corresponding to the first sensor 40*a* and the second sensor 40*b*. Each of the test patch 200 and the test patch 300 is formed so that parallelogram patches of yellow (Y), magenta (M), cyan (C), and black (Bk) and parallelogram patches of yellow (Y), magenta (M), cyan (C), and black (Bk) are symmetrical with each other across a reference line.

The test patch 200 and the test patch 300 move as the intermediate transfer belt 10 moves, and diffuse and reflect the infrared light radiated from the light emitting element 41*a*, while passing through a position where the detection unit 40 faces the intermediate transfer belt 10. The registration correction is performed on the basis of a result obtained when the first sensor 40*a* and the second sensor 40*b* detect the diffused reflected light of the infrared light radiated to the test patch 200 and the test patch 300.

Among the infrared light radiated from the light emitting element 41*a* and the light emitting element 41*b* which are provided in the respective sensors, the reflected light from the intermediate transfer belt 10 is mainly specularly-reflected light and the reflected light from the toner of yellow (Y), magenta (M), and cyan (C) is diffused reflected light. That is, by detecting a timing at which a detection waveform of the diffused reflected light when the infrared light is radiated from the light emitting element 41*a* and the light emitting element 41*b* exceeds a preset threshold, it is possible to detect an edge of the toner of each of the colors of the test patch 200 and the test patch 300 and specify a position thereof. Since the infrared light is mainly absorbed by the toner of black, a position of the black toner is able to be specified by overlapping the toner of black and the toner of another color as illustrated in FIG. 4.

A light receiving intensity of the diffused reflected light received by the light receiving element 43*a* and the light receiving element 43*b* is converted into a voltage in the controller 274. Here, as a dynamic range which is a difference between a detection output of the intermediate transfer belt 10 and a detection output of the test patch 200 or the test patch 300 is wider, the edge of the toner is able to be detected stably regardless of external noise or the like.

The controller 274 detects a passing timing of the test patch 200 and the test patch 300 on the basis of the output from the detection unit 40 and calculates the position. By comparing the timing to a predetermined timing, the controller 274 calculates a relative amount of a color deviation in a main scanning direction and a sub-scanning direction among the toner of the respective colors, a magnification in the main scanning direction, a relative inclination, or the like. In accordance with a result thereof, relative positions of the toner of the respective colors are corrected, so that the registration correction is performed.

[Explanation of Intermediate Transfer Belt]

In a case where the intermediate transfer belt has a high transmission property so that radiation light from the detection unit 40 is transmitted through the intermediate transfer belt and reflected light is generated from a counter object, the dynamic range described above may be reduced. Thus, it is necessary to reduce the transmission property of the intermediate transfer belt to perform detection stably.

Figures 5, 6:
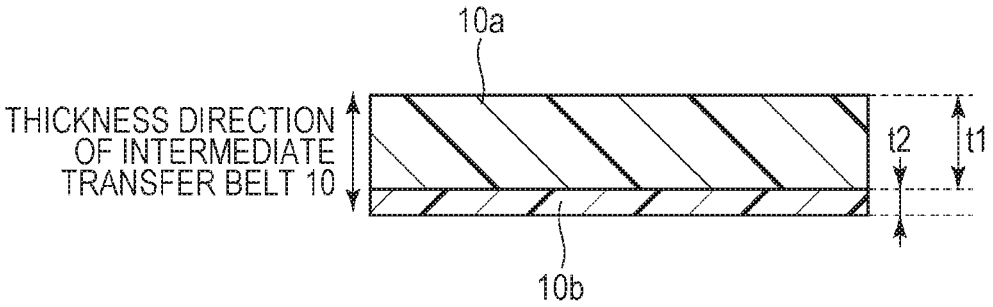
FIG. 5 is a schematic view of a configuration of an intermediate transfer belt, according to one or more embodiment of the subject disclosure.
FIG. 6 is a table for explaining a light transmittance of an intermediate transfer belt, according to one or more embodiment of the subject disclosure and a comparative example 1.

FIG. 5 illustrates a sectional surface of the intermediate transfer belt 10 in the present exemplary embodiment. As illustrated in FIG. 5, the intermediate transfer belt 10 has a base layer 10*a* (first layer) and an inner surface layer 10*b* (second layer) which serves as an infrared light absorption layer. Here, the base layer 10*a* is defined as a layer that is the thickest among layers forming the intermediate transfer belt 10 in a thickness direction of the intermediate transfer belt 10. In the present exemplary embodiment, the inner surface layer 10*b* is formed by applying spray coating on an inner circumferential surface of a substrate of the base layer 10*a* and blow molding is performed, so that the intermediate transfer belt 10 having a plurality of layers is obtained. After the blow molding, a thickness t1 of the base layer 10*a* is 64 μm and a thickness t2 of the inner surface layer 10*b* is 1 μm. The thickness t1 of the base layer 10*a* is desired to be in a range of 55 to 85 μm by considering a handling property in assembling and traces of stretching by the support roller 11, the stretching roller 12, and the facing roller 13.

In the present exemplary embodiment, a blow molding temperature, a speed, and the like of the intermediate transfer belt 10 are optimized so that a difference of the circumferential length at both ends of the intermediate transfer belt 10 in the width direction (main scanning direction) orthogonal to the movement direction is 0.5 mm or less and film thickness unevenness is 15 μm or less. Further, the blow molding temperature, the speed, and the like of the intermediate transfer belt 10 are optimized so that an elastic coefficient of the intermediate transfer belt 10 is about 2000 Mpa. Examples of a molding method of the intermediate transfer belt 10 include, in addition to the blow molding, centrifugal molding, tube extrusion, inflation molding, extrusion molding, and cylinder extrusion molding.

The base layer 10*a* is made of endless polyethylene naphthalate (PEN) mixed with an ion conductive agent as a conductive agent and has 0.1 mass % of dye added to perform blow molding. An amount of the ion conductive agent added to the base layer 10*a* is adjusted so that a volume resistivity of the intermediate transfer belt 10 is $5\times10^{9}$ Ω·cm. The volume resistivity of the base layer 10*a* may be in a range of $1\times10^{8}$ to $1\times10^{12}$ Ω·cm and is more desirably in a range of $1\times10^{8}$ to $1\times10^{11}$ Ω·cm. Further, a surface gloss of the base layer 10*a* is adjusted to be 30 or more (the gloss is measured by Handy Gloss Meter IG-320 manufactured by Horiba, Ltd.) so that the infrared light radiated from the detection unit 40 is specularly-reflected by the surface of the intermediate transfer belt 10.

The inner surface layer 10*b* is made of polyurethane mixed with 50 mass % of phthalocyanine-based dye colorant as a coloring agent. A resistance value of the inner surface layer 10*b* is adjusted in a range of $1\times10^{4}$ to $1\times10^{10}$ Ω·cm by adding an ion conductive agent.

Here, a surface resistivity measured from the outer circumferential surface side of the intermediate transfer belt 10 is defined as a surface resistivity of the base layer 10*a*, and a surface resistivity measured from the inner circumferential surface side (inner surface layer 10*b* side) of the intermediate transfer belt 10 is defined as a surface resistivity of the inner surface layer 10*b*. In the configuration of the present exemplary embodiment, the surface resistivity of the base layer 10*a* may be in a range of $5.0\times10^{8}$Ω/□ to $1.0\times10^{12}$Ω/□ and is more desirably in a range of $1.0\times10^{9.5}$Ω/□ to $1.0\times10^{11}$Ω/□. The surface resistivity of the inner surface layer 10*b* may be in a range of $1.0\times10^{7}$Ω/□ or less and is more desirably in a range of $1.0\times10^{6}$Ω/□ or less.

The volume resistivity and the surface resistivity of the intermediate transfer belt 10 are measured by using Hiresta-UP (MCP-HT450) manufactured by Mitsubishi Chemical Corporation in a measurement environment of a temperature of 23° C. and a humidity of 50%. The volume resistivity is measured by using a ring probe of type UR (Model: MCP-HTP12) under a condition that the probe is brought into contact with the outer circumferential surface of the intermediate transfer belt 10 at an applied voltage of 100 V and a measurement time of 10 seconds. The surface resistivity is measured by using a ring probe of type UR100 (Model: MCP-HTP16) under a condition of an applied voltage of 100 V and a measurement time of 10 seconds for the outer circumferential surface side and an applied voltage of 10 V and a measurement time of 10 seconds for the inner circumferential surface side. The surface resistivity of the inner circumferential surface side of the intermediate transfer belt 10, that is, the surface resistivity of the inner surface layer 10*b* is measured by making the probe contact with the inner surface layer 10*b* side. The surface resistivity of the outer circumferential surface side of the intermediate transfer belt 10, that is, the surface resistivity of the base layer 10*a* is measured by making the probe contact with the base layer 10*a* side.

Action and Effect of Present Exemplary Embodiment

FIG. 6 illustrates a result of measurement of a light transmittance of an intermediate transfer belt when a wavelength is 800 nm in the present exemplary embodiment and a comparative example 1. The measurement is performed by using an ultraviolet-visible-infrared spectrophotometer (UH4150 manufactured by Hitachi High-Tech Science Corporation) and arranging the intermediate transfer belt 10 between a light emitting unit and a detection unit of the spectrophotometer. More specifically, the measurement is performed with a distance of 290 mm between the light emitting unit and the intermediate transfer belt 10 and a distance of 190 mm between the intermediate transfer belt 10 and the detection unit. Note that, an intermediate transfer belt of the comparative example 1 has a configuration in which the inner surface layer 10*b* in the intermediate transfer belt 10 of the present exemplary embodiment is not included but only a layer corresponding to the base layer 10*a* is included.

As illustrated in FIG. 6, the light transmittance for the light with the wavelength of 800 nm in the present exemplary embodiment is 2.0% and a result indicating that the infrared light is hardly transmitted is obtained. On the other hand, because of not including the inner surface layer 10*b*, the intermediate transfer belt of the comparative example 1 exhibits a light transmission property higher than that of the intermediate transfer belt 10 of the present exemplary embodiment and has the light transmittance of 12% for the light with the wavelength of 800 nm.

Figure 7A:
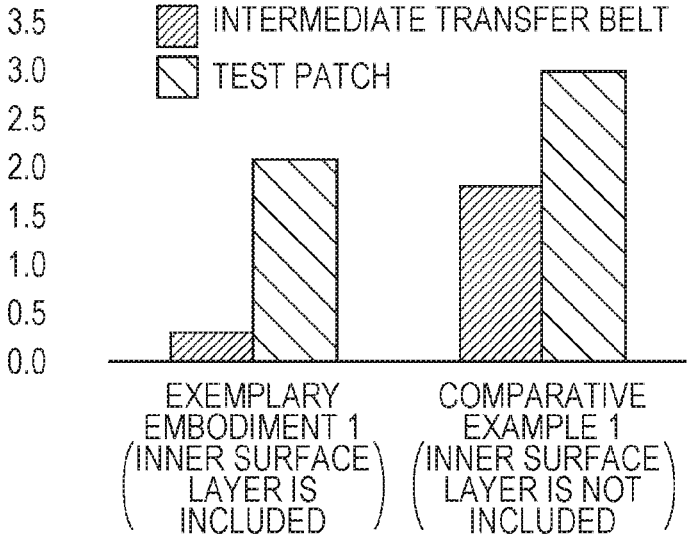
FIGS. 7A and 7B are graphs each indicating a detection result by the detection unit in, according to one or more embodiment of the subject disclosure and the comparative example 1.
Figure 7B:
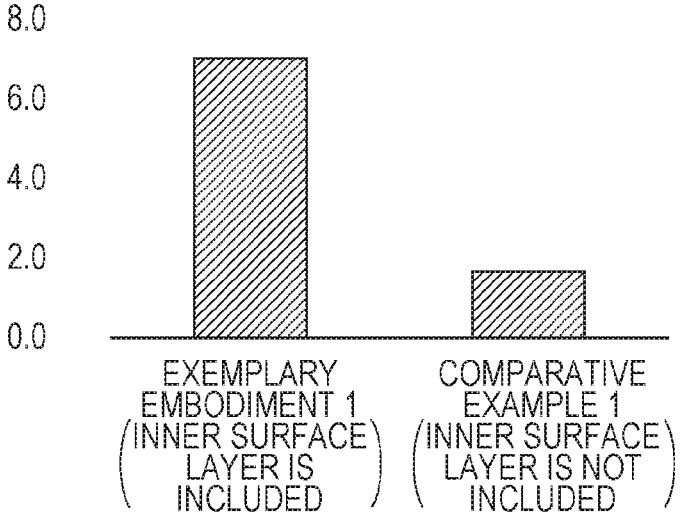

FIG. 7A illustrates a result obtained by, when each of the intermediate transfer belts of the present exemplary embodiment and the comparative example 1 is used, detecting by the light receiving element 43*a* diffused reflected light from the surface of the intermediate transfer belt and diffused reflected light from a test patch formed on the intermediate transfer belt. FIG. 7B illustrates a ratio obtained by dividing a detection output of the test patch by a detection output of the surface of the intermediate transfer belt in the present exemplary embodiment and the comparative example 1 on the basis of the detection result of FIG. 7A and illustrates an index of the dynamic range. It is indicated that as a value of a vertical axis increases, the dynamic range is wide and the test patch is able to be detected stably.

Figure 8A:
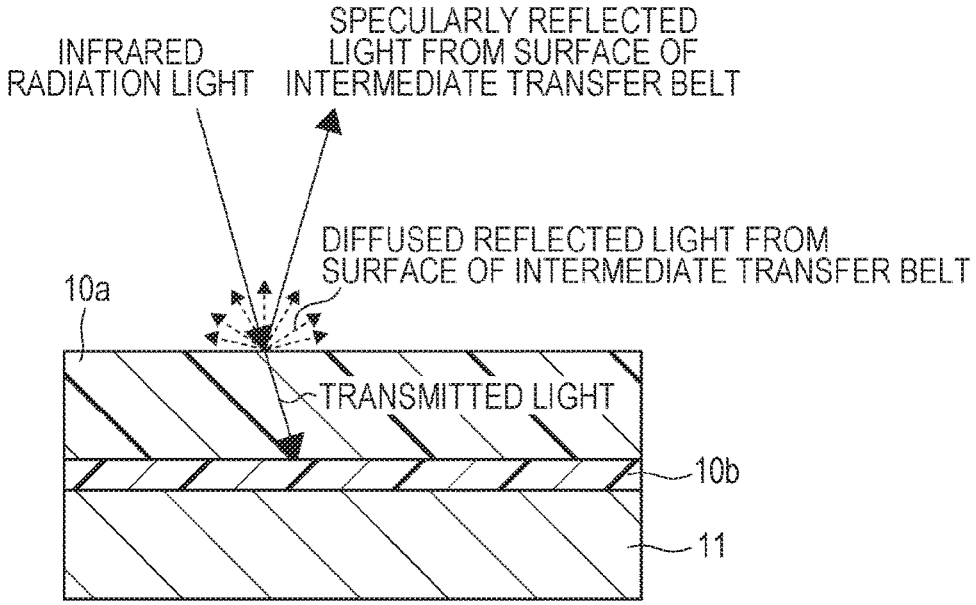
FIGS. 8A and 8B are schematic views for respectively explaining reflection of infrared light radiated to the intermediate transfer belt, according to one or more embodiment of the subject disclosure and the comparative example 1.
Figure 8B:
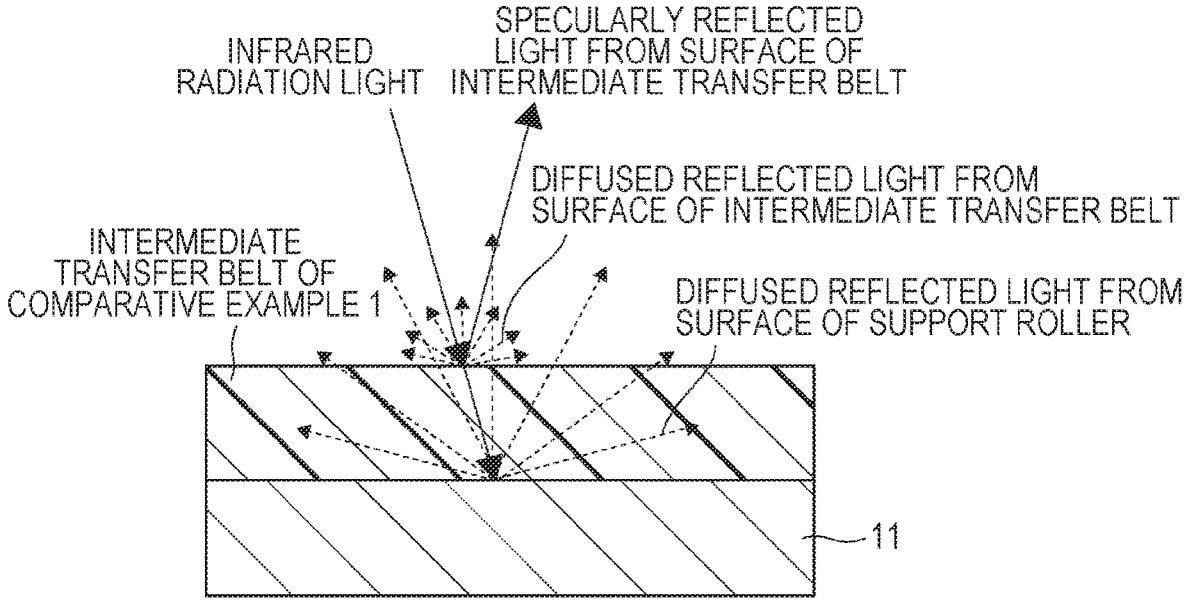

As illustrated in FIG. 7A, in the configuration of the present exemplary embodiment, the detection result of the diffused reflected light from the surface of the intermediate transfer belt 10, which is obtained by the light receiving element 43*a*, is 0.3 V. On the other hand, in the configuration of the comparative example 1, the detection result of the diffused reflected light from the surface of the intermediate transfer belt is 1.8 V and indicates a value higher than that of the present exemplary embodiment. A reason therefor will be described with reference to FIGS. 8A and 8B. FIG. 8A is a schematic view for explaining reflection of the infrared light when the infrared light is radiated to the intermediate transfer belt 10 in the configuration of the present exemplary embodiment. FIG. 8B is a schematic view for explaining reflection of the infrared light when the infrared light is radiated to the intermediate transfer belt in the configuration of the comparative example 1.

As illustrated in FIG. 8A, when the infrared light is radiated to the intermediate transfer belt 10, the infrared light is slightly diffused and reflected by the surface of the base layer 10*a* and a part of the infrared light transmitted through the base layer 10*a* is absorbed by the inner surface layer 10*b*. On the other hand, in the configuration of the comparative example 1 in which the inner surface layer 10*b* is not included, as illustrated in FIG. 8B, when the infrared light is radiated to the intermediate transfer belt, not only the diffused reflected light from the surface of the intermediate transfer belt but also a part of the infrared light transmitted through the intermediate transfer belt is diffused and reflected by a surface of the support roller 11. In particular, the support roller 11 that is made of stainless steel as a metal member easily reflects the infrared light due to a surface property thereof. As a result, as illustrated in FIG. 7A, the detection result of the diffused reflected light from the surface of the intermediate transfer belt in the configuration of the comparative example 1 indicates a value higher than that of the present exemplary embodiment.

Figure 9A:
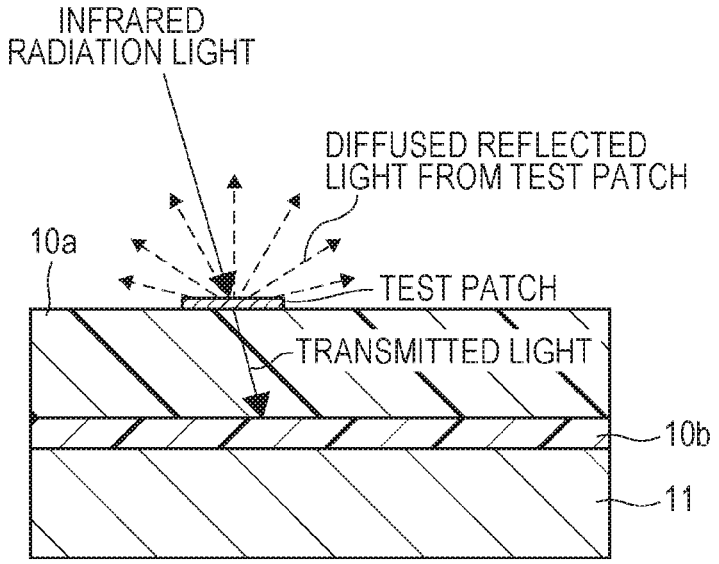
FIGS. 9A and 9B are schematic views for respectively explaining reflection of infrared light radiated to a detection toner image, according to one or more embodiment of the subject disclosure and the comparative example 1.
Figure 9B:
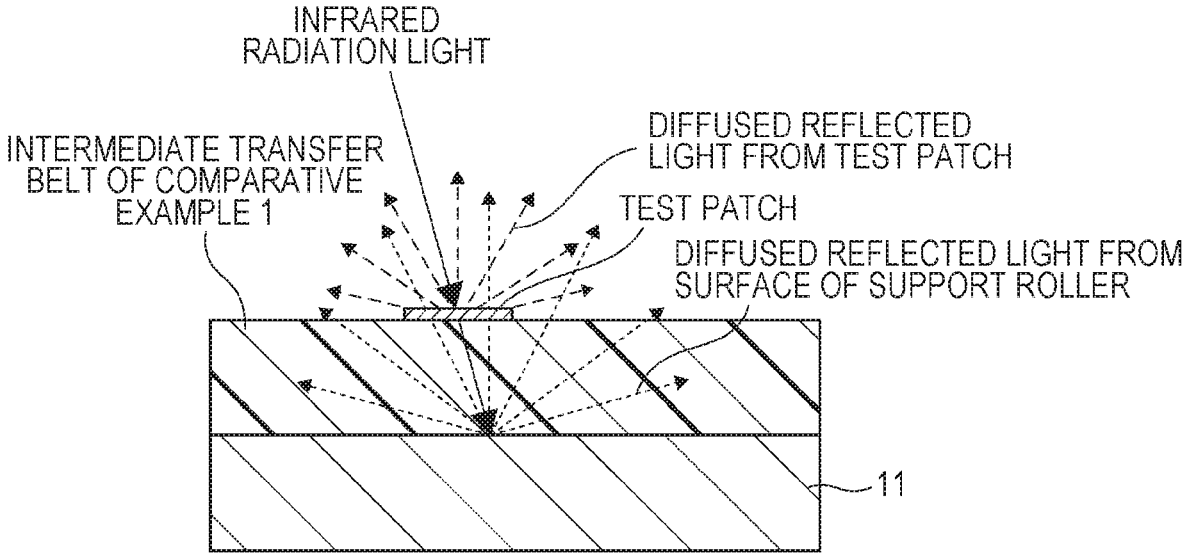

Moreover, as illustrated in FIG. 7A, in the configuration of the present exemplary embodiment, the detection result of the diffused reflected light from the test patch, which is obtained by the light receiving element 43*a*, is 2.1 V. On the other hand, in the configuration of the comparative example 1, the detection result of the diffused reflected light from the test patch is 3.0 V and indicates a value higher than that of the preset exemplary embodiment. A reason therefor will be described with reference to FIGS. 9A and 9B. FIG. 9A is a schematic view for explaining reflection of the infrared light when the infrared light is radiated to the test patch formed on the intermediate transfer belt 10 in the configuration of the present exemplary embodiment. FIG. 9B is a schematic view for explaining reflection of the infrared light when the infrared light is radiated to the test patch formed on the intermediate transfer belt in the configuration of the comparative example 1.

As illustrated in FIG. 9A, when the infrared light is radiated to the test patch formed on the intermediate transfer belt 10, the infrared light is diffused and reflected by the surface of the test patch and a part of the infrared light transmitted through the test patch and the base layer 10*a* is absorbed by the inner surface layer 10*b*. On the other hand, in the configuration of the comparative example 1 in which the inner surface layer 10*b* is not included, as illustrated in FIG. 9B, not only the infrared light diffused and reflected by the surface of the test patch but also a part of the infrared light transmitted through the test patch and the intermediate transfer belt is diffused and reflected by the surface of the support roller 11. As a result, as illustrated in FIG. 7A, the detection result of the diffused reflected light from the surface of the test patch in the configuration of the comparative example 1 indicates a value higher than that of the present exemplary embodiment.

As illustrated in FIG. 7B, in the configuration of the present exemplary embodiment, a value of the dynamic range obtained from the detection result of FIG. 7A is 7.0. According to the result, the registration correction is able to be performed stably in the configuration of the present exemplary embodiment regardless of disturbance such as deterioration of the intermediate transfer belt 10 over time or contamination of each of the sensors of the detection unit 40. On the other hand, in the configuration of the comparative example 1, the value of the dynamic range is 1.7 and indicates a value lower than that of the present exemplary embodiment. That is, when the intermediate transfer belt of the comparative example 1 is used, there is a possibility that a sufficient dynamic range is not able to be secured and the registration correction is not able to be performed stably depending on disturbance such as deterioration of the intermediate transfer belt over time or contamination of the sensor.

As described above, in the present exemplary embodiment, the inner surface layer 10*b* as the infrared light absorption layer is provided on the inner circumferential surface side of the base layer 10*a*, so that the transmission property of the intermediate transfer belt 10 is able to be reduced without deteriorating uniformity of the electrical resistance value of the intermediate transfer belt 10. Thereby, when correction control to correct the image formation condition such as a position or density of an image is executed, occurrence of erroneous detection caused when the light radiated from the detection unit 40 to the intermediate transfer belt 10 and the test patch is transmitted through the intermediate transfer belt 10 is able to be suppressed.

When the light transmittance is suppressed to 7.5% or less by the inner surface layer 10*b*, the dynamic range is 3.0 or more and stable registration detection is able to be expected. It is more desirable that the light transmittance is 6.0% or less so that the dynamic range is secured to be 4.0 or more.

The example in which the registration correction is performed by using the detection result of the diffused reflected light has been described in the present exemplary embodiment, but there is no limitation thereto and the registration correction is also able to be performed by using a detection result of specularly-reflected light. Also in such a case, by providing the inner surface layer 10*b*, it is possible to stabilize accuracy of the detection in the correction control.

In a case where the registration correction is performed by using a detection result of specularly-reflected light, the correction control is performed by utilizing that the light receiving element 42*a* that detects the specularly-reflected light exhibits strong light receiving intensity with respect to the intermediate transfer belt 10 but weak light receiving intensity with respect to the test patch. More specifically, since the light receiving element 42*a* receives only reflected light in a specular reflection direction among the diffused reflected light from the test patch, the light receiving intensity becomes weak in a border between the intermediate transfer belt 10 and the test patch. Thus, by detecting a timing when a detection output exceeds a predetermined threshold before and after passing of the test patch, a position of the test patch is able to be specified.

The detection of the specularly-reflected light has a characteristic that a reflection direction changes due to surface unevenness of a reflective object and the light receiving intensity greatly changes. Thus, in a case where a foreign substance from outside, scraping powder of the intermediate transfer belt 10, or the like is accumulated on the support roller 11, when the infrared light is transmitted through the intermediate transfer belt 10 and radiated to the foreign substance, a reflection component in the specular reflection direction is reduced, so that the foreign substance may be erroneously detected as the test patch. According to the configuration of the present exemplary embodiment, by forming the inner surface layer 10*b*, the light transmitted through the intermediate transfer belt 10 among the infrared light radiated from the detection unit 40 is absorbed by the inner surface layer 10*b*, thus making it possible to prevent such erroneous detection.

Figure 10:
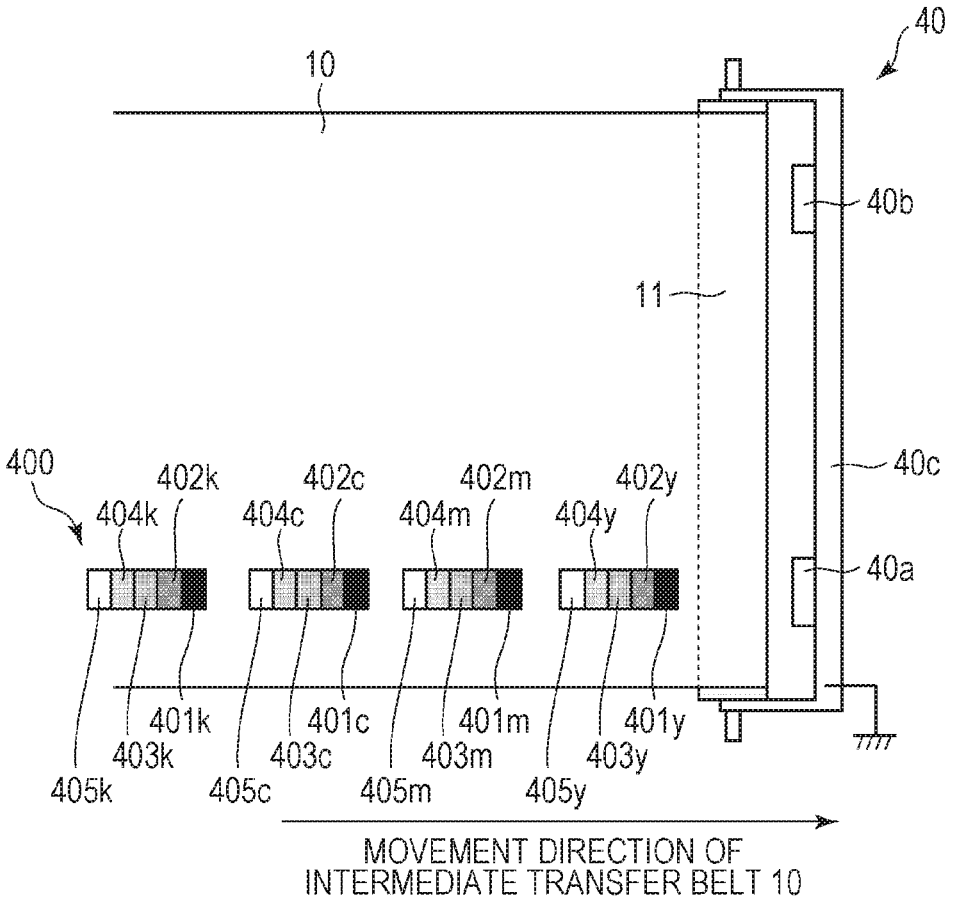
FIG. 10 is a schematic view of a detection toner image when correction control to correct a density of an image is executed, according to one or more embodiment of the subject disclosure.
Figure 11A:
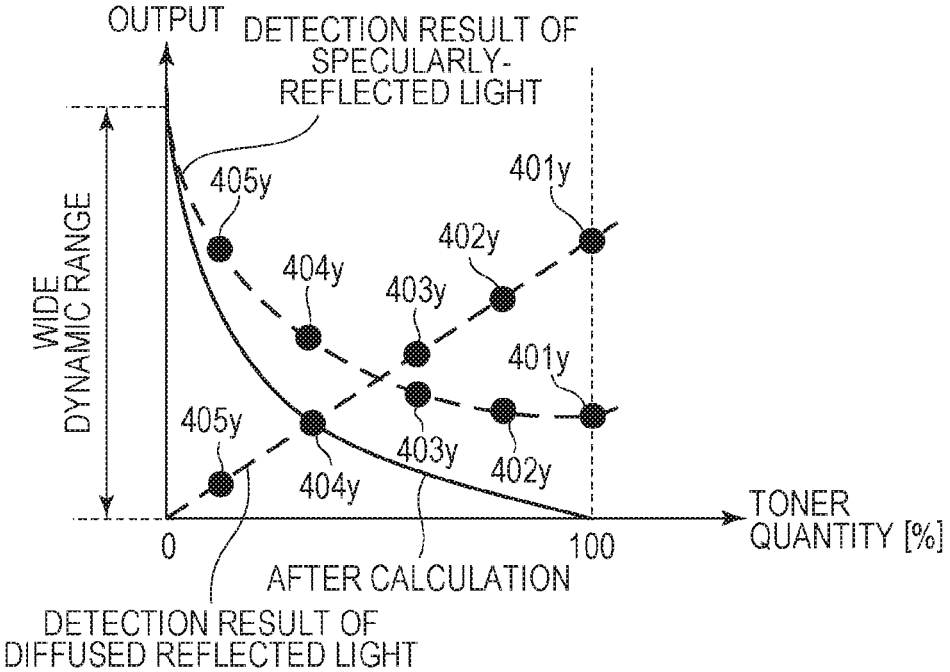
FIGS. 11A and 11B respectively illustrate a detection result of a detection toner image when correction control to correct a density of an image is executed, according to one or more embodiment of the subject disclosure and the comparative example 1.

Though the registration correction has been described in the present exemplary embodiment, the disclosure is not limited thereto and is effective also when density correction to correct a density of an image is performed as correction control of the image formation condition by the detection unit 40. The density correction will be briefly described below with reference to FIGS. 10, 11A, and 11B. FIG. 10 is a schematic view of a test patch 400 formed on the intermediate transfer belt 10 when density correction is executed. FIG. 11A is a graph of a detection result of the test patch 400 in the configuration of the present exemplary embodiment and FIG. 11B is a graph indicating a detection result of the test patch 400 in the configuration of the comparative example 1 in which the inner surface layer 10*b* is not provided in the intermediate transfer belt.

As illustrated in FIG. 10, when the density correction is performed, patterns of yellow (Y), magenta (M), cyan (C), and black (Bk) each having five gradations are formed at positions corresponding to the first sensor 40*a* of the intermediate transfer belt 10. The detection result of the test patch 400 by the first sensor 40*a* is processed by the controller 274. Specifically, a signal of a light receiving quantity of the first sensor 40*a* is subjected to A/D (analog-to-digital) conversion and then output to the controller 274, and a net quantity of the specularly-reflected light is calculated by the CPU 276 in the controller 274. Then, on the basis of a result thereof, the controller 274 sets a density factor such as a charging voltage, a development voltage, or a quantity of exposure light. A result of the setting of the density factor is stored in the memory 275 in the controller 274 and used, for example, when image formation is performed or next density correction is executed.

Here, as an example, a detection result of the yellow gradation pattern of the test patch 400 in the configuration of the present exemplary embodiment is indicated in FIG. 11A. In the density correction, a detection output is standardized so that a detection output of the specularly-reflected light and a detection output of the diffused reflected light in a patch 401Y at which a toner quantity (density) is 100% are equal, and a difference between an output of the specularly-reflected light and an output of the diffused reflected light is obtained to thereby calculate a net quantity of the specularly-reflected light. By performing such calculation, the graph after the calculation as illustrated in FIG. 11A is obtained, and the density correction is performed on the basis of a result in which the net quantity of the specularly-reflected light and the toner quantity are associated. In the present exemplary embodiment, though description has been given by taking yellow as an example, the calculation is able to be performed in a similar manner also for magenta, cyan, and black.

Figure 11B:
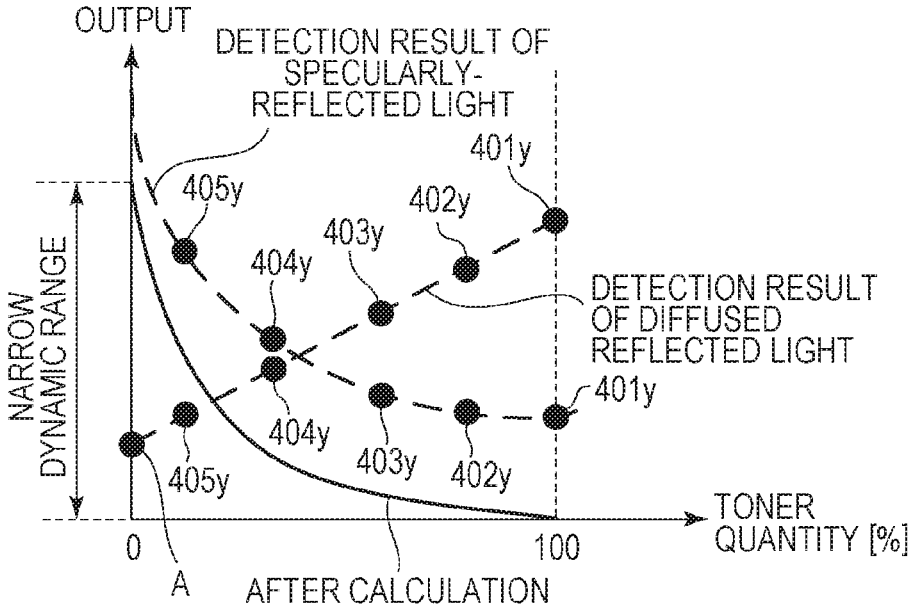

As illustrated in FIG. 11B, in the configuration of the comparative example 1 using the intermediate transfer belt that does not include the inner surface layer 10*b*, the net quantity of the specularly-reflected light after the calculation when the toner quantity is zero is smaller than that of the present exemplary embodiment. In the configuration of the comparative example 1, the infrared light radiated from the light emitting element 41*b* is transmitted through the intermediate transfer belt and diffused and reflected by the surface of the support roller 11. When the diffused reflected light is detected by the light receiving element 43*b*, a result indicating that the detection output of the light receiving element 43*b* is not zero even when the toner quantity is zero as indicated by a dot A of FIG. 11A is obtained. As a result, as illustrated in FIGS. 11A and 11B, the dynamic range in the configuration of the comparative example 1 is narrower than the dynamic range in the configuration of the present exemplary embodiment using the intermediate transfer belt 10 that includes the inner surface layer 10*b*. Thus, it is desirable also in the density correction that the inner surface layer 10*b* is formed and the light transmitted through the base layer 10*a* is absorbed by the inner surface layer 10*b* as in the present exemplary embodiment.

Though the PEN is used as the resin material of the substrate of the intermediate transfer belt 10 in the present exemplary embodiment, thermoplastic resin, thermosetting resin, or the like is usable. Further, an additive such as conductive polymer as a conductive agent, an electrolyte, a compatibilizer, a dispersing agent, and various fillers may be applied additionally in accordance with a property that is required.

Note that, though 0.1 mass % of dye is added as the coloring agent added to the base layer 10*a* in the present exemplary embodiment, transmission of the infrared light is able to be suppressed by further adding the coloring agent. The base layer 10*a* is thicker than the inner surface layer 10*b* and is thus able to suppress transmission of the infrared light even when the addition amount is small. In order to achieve a range not to cause a problem in variation of the electric resistance or a molding property of the intermediate transfer belt 10, however, the addition of the coloring agent to the base layer 10*a* is desired to be adjusted in a range of 0.5 mass % or less.

Though 50 mass % of phthalocyanine-based dye colorant is added to the inner surface layer 10*b* with the thickness of 1 μm in the present exemplary embodiment, the inner surface layer 10*b* may be made thicker to further suppress transmission of the infrared light. For example, when the thickness of the inner surface layer 10*b* is 2 μm, the amount of the phthalocyanine-based dye colorant added in the thickness of 2 μm is twice that of a case where the thickness is 1 μm, so that the transmission of the infrared light is reduced. When the thickness of the inner surface layer 10*b* is increased up to 4 μm, the transmittance is almost 0%.

Even when the film thickness of the inner surface layer 10*b* is 1 μm, the transmittance of the infrared light is able to be reduced by increasing the phthalocyanine-based dye colorant. For example, when 75 mass % of dye colorant is added, the transmittance is almost 0%. The addition amount of the phthalocyanine-based dye colorant may be appropriately adjusted in view of a material cost or a range in which a desired dynamic range is obtained. In the configuration of the image forming apparatus 100 of the present exemplary embodiment, when the addition amount of the phthalocyanine-based dye colorant is 40 mass % or more, the transmittance of the infrared light is 4% or less and a sufficient effect is obtained. Moreover, the thickness of the inner surface layer 10*b* may be 1 μm or more in view of the transmittance of the infrared light and may be 10 μm or less to secure appropriate flexibility in view of prevention of cracking of the intermediate transfer belt 10 due to an increase in hardness of the intermediate transfer belt 10.

Though the polyurethane is used as the material used for the inner surface layer 10*b*, thermoplastic resin, thermosetting resin, ultraviolet-curing resin, or the like is usable. An example of a method of molding the inner surface layer 10*b* includes two-color molding with the substrate, for example, by spin coating or roll coating in addition to spray coating. Further, though the inner surface layer 10*b* is formed on the inner circumferential surface side of the intermediate transfer belt 10 in the present exemplary embodiment, there is no limitation thereto and a similar effect to that of the present exemplary embodiment is also able to be obtained when the infrared light absorption layer of the present exemplary embodiment is provided on the outer circumferential surface side of the intermediate transfer belt 10. When the infrared light absorption layer is provided on the outer circumferential surface side of the intermediate transfer belt 10, the infrared light absorption layer may be formed by spray coating similarly to the inner surface layer 10*b* of the present exemplary embodiment or may be formed by another method described above.

The configuration in which the first sensor 40*a* capable of detecting specularly-reflected light and diffused reflected light and the second sensor 40*b* capable of detecting diffused reflected light are provided as the detection unit 40 has been described in the present exemplary embodiment. However, there is no limitation thereto and both of the two sensors may be sensors capable of detecting specularly-reflected light and diffused reflected light. A configuration may be such that only a light receiving element detecting specularly-reflected light is provided as the second sensor 40*b* but a light receiving element detecting diffused reflected light is not provided or that one sensor detects specularly-reflected light and the other sensor detects diffused reflected light. According to the configuration in which one of the two sensors is able to detect specularly-reflected light and diffused reflected light as in the present exemplary embodiment, since a light receiving element detecting specularly-reflected light is not provided in the second sensor 40*b*, it is possible to achieve simplification of the configuration of the second sensor 40*b* and cost reduction.

Moreover, in order to detect a positional deviation in the main scanning direction when the registration correction is performed, it is desirable that two sensors are provided as in the present exemplary embodiment, but there is no limitation thereto and only one first sensor 40*a* may be provided or the number of sensors may be increased to three or more.

Figure 12:
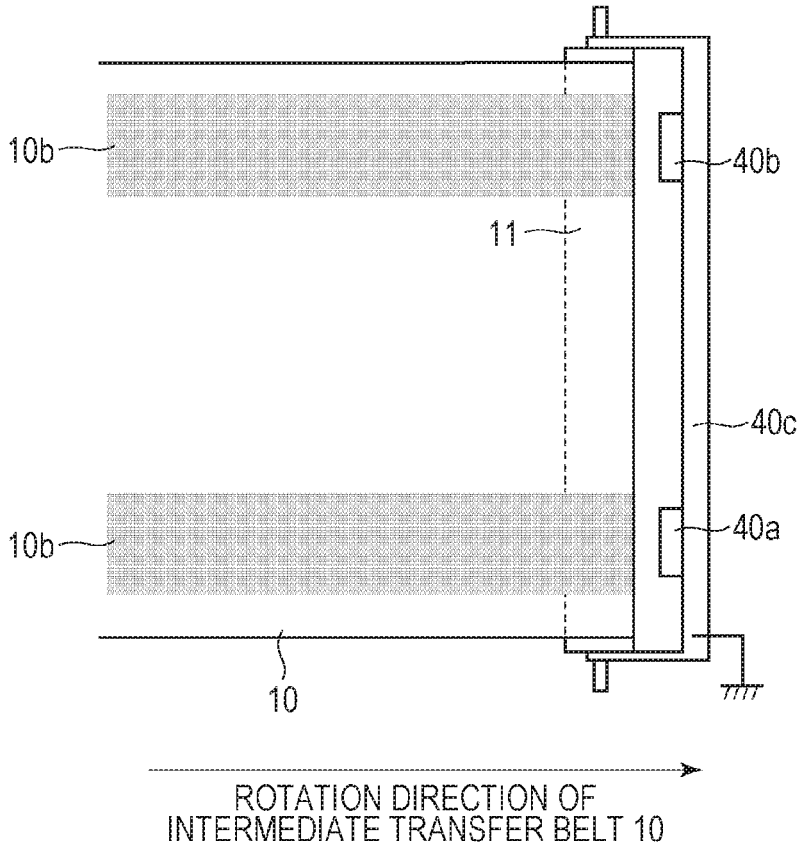
FIG. 12 is a schematic view of a configuration of an intermediate transfer belt, according to one or more embodiment of the subject disclosure.

In the present exemplary embodiment, the inner surface layer 10*b* is formed on the entire inner circumferential surface side of the base layer 10*a* of the intermediate transfer belt 10. However, there is no limitation thereto and the inner surface layer 10*b* may be formed only at positions corresponding to the first sensor 40*a* and the second sensor 40*b* as illustrated in FIG. 12. The inner surface layer 10*b* may be formed at least in a region of one full circumference of the intermediate transfer belt 10, which faces the positions where the first sensor 40*a* and the second sensor 40*b* are arranged in the width direction of the intermediate transfer belt 10. The inner surface layer 10*b* is applied to a rear side of the base layer 10*a* by spray coating, spin coating, roll coating, or the like, and it takes longer time to form the layer as an application region is larger, and a material cost increases as the application region is larger. Thus, by applying the inner surface layer 10*b* to a required minimum region as illustrated in FIG. 12, it is possible to shorten a time of a formation step and suppress a material cost.

Exemplary Embodiment 2

The configuration in which the phthalocyanine-based dye colorant is used as the coloring agent of the inner surface layer 10*b* has been described in the exemplary embodiment 1. On the other hand, a configuration in which carbon black is used as a coloring agent of an inner surface layer 110*b* will be described in an exemplary embodiment 2. Note that, the configuration of the present exemplary embodiment is almost the same as that of the exemplary embodiment 1 except for that the carbon black is used as the coloring agent of the inner surface layer 110*b*. Thus, hereinafter, a part common to that of the exemplary embodiment 1 will be given the same reference sign and description thereof will be omitted.

Figure 13:
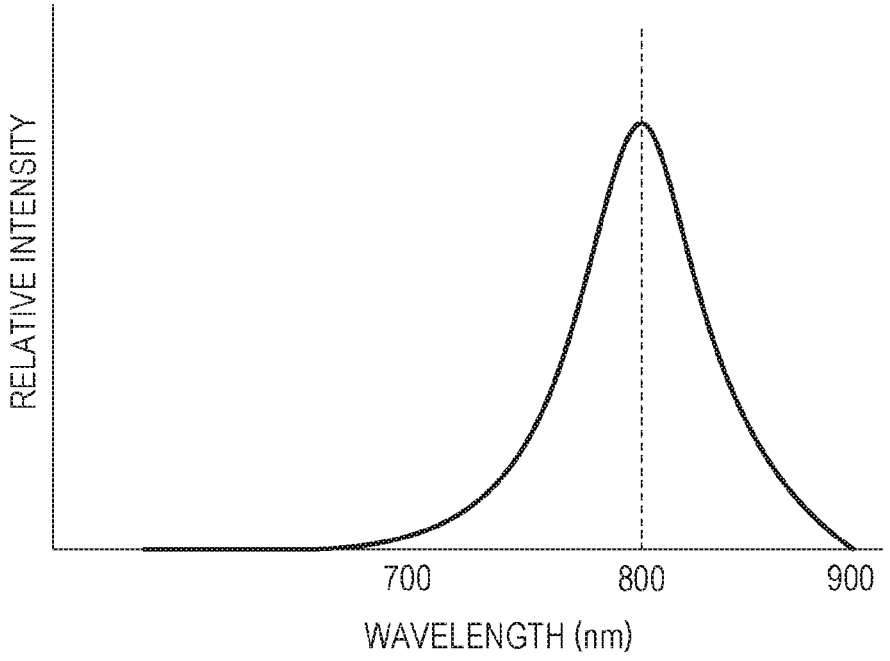
FIG. 13 is a graph for explaining wavelength distribution of a light emitting element that has distribution in a wavelength region.

In a case of the dye colorant, when only a single compound is added, absorption efficiency is high in a specific wavelength region, but the absorption efficiency is reduced in the other wavelength region. Thus, for example, in a case of a light emitting element that has distribution in a wavelength region as illustrated in FIG. 13 or in a case where a peak wavelength varies due to individual variations of light emitting elements, radiation light of a part of the wavelength region may be transmitted through the inner surface layer 10*b*. In order to sufficiently obtain an effect of absorbing the infrared light by the inner surface layer 10*b*, a colorant that is able to widely absorb the infrared light near 800 nm which is the peak wavelength of the light emitting elements 41*a* and 41*b* needs to be added. In a case where the dye colorant is used as the coloring agent, however, a plurality of compounds need to be mixed and added, so that an addition amount may be increased.

Figure 14:
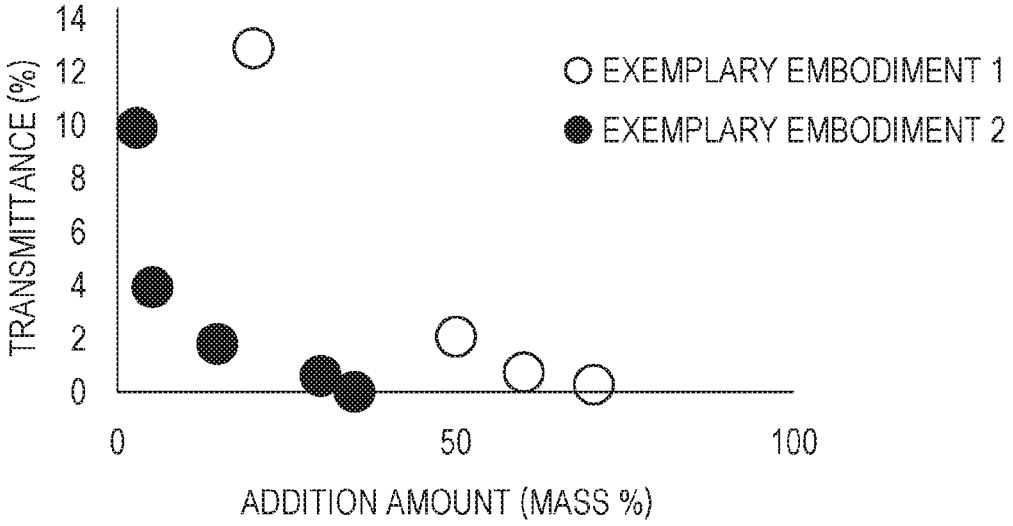
FIG. 14 is a graph for explaining a relationship between an addition amount of a coloring agent and a transmittance of infrared light, according to one or more embodiment of the subject disclosure.

Thus, in the present exemplary embodiment, the carbon black is added to the inner surface layer 110*b* as the coloring agent that is able to widely absorb the light of an infrared wavelength region even when an addition amount is small. FIG. 14 is a graph for explaining a relationship between the addition amount of the coloring agent and the transmittance of the infrared light in each of intermediate transfer belts of the exemplary embodiment 1 and the exemplary embodiment 2. As illustrated in FIG. 14, when comparison is performed with the same addition amount, the transmittance of the infrared light in an intermediate transfer belt 110 in which the carbon black is added to the inner surface layer 110*b* is lower than the transmittance of the infrared light in the intermediate transfer belt 10 in which the phthalocyanine-based dye colorant is added to the inner surface layer 10*b*.

That is, in a case where the carbon black is used as the coloring agent, with the addition amount less than that of the phthalocyanine-based dye colorant, an equivalent absorption efficiency of the infrared light is obtained. In this manner, in the present exemplary embodiment, by adding the carbon black to the inner surface layer 110*b* as the coloring agent, it is possible to obtain a similar effect to that of the exemplary embodiment 1 and also possible to achieve the inner surface 110*b* in which the absorption efficiency of the infrared light is further improved.

Note that, in the configuration of the present exemplary embodiment, when the amount of the carbon black added to the inner surface layer 110*b* is 5 mass % or more, the transmittance of the infrared light is 4% or less and a sufficient effect is obtained. On the other hand, in a case where the amount of the carbon black added to the inner surface layer 110*b* increases, when the intermediate transfer belt 110 is rotated and moved, the intermediate transfer belt 110 contacts support rollers 11, 12, and 13, so that the inner surface layer 110*b* may be scraped off. Thus, the amount of the carbon black added to the inner surface layer 110*b* is desirably 5 mass % to 50 mass % or less, and is more desirably in a range of 5 mass % to 20 mass %.

In the present exemplary embodiment, the intermediate transfer belt 110 in which a base layer 110*a* and the inner surface layer 110*b* are different in electric resistance by adding the carbon black is used, and the electric resistance of the inner surface layer 110*b* is set to be lower than that of the base layer 110*a*. Here, a surface resistivity measured from the outer circumferential surface side (base layer 110*a* side) of the intermediate transfer belt 110 is defined as the electric resistance of the base layer 110*a*, and a surface resistivity measured from the inner circumferential surface side (inner surface layer 110*b* side) thereof is defined as the electric resistance of the inner surface layer 110*b*. That is, in the intermediate transfer belt 110 of the present exemplary embodiment, the surface resistivity measured from the outer circumferential surface side and the surface resistivity measured from the inner circumferential surface side have different values and an electric resistance value of the surface resistivity measured from the inner circumferential surface side is smaller than that of the surface resistivity measured from the outer circumferential surface side.

Further, in the intermediate transfer belt 110 of the present exemplary embodiment, because of a relationship between the base layer 110*a* and the inner surface layer 110*b* with respect to the electric resistances and the thicknesses thereof, the volume resistivity of the intermediate transfer belt 110 reflects the electric resistance of the base layer 110*a*. In a reference environment (with a temperature of 23° C. and a humidity of 50%), the surface resistivity measured from the outer circumferential surface side of the intermediate transfer belt 110 is $3.2\times10^{9}\Omega/\square$ and the surface resistivity measured from the inner circumferential surface side of the intermediate transfer belt 110 is $1.0\times10^{6}\Omega/\square$. Moreover, the volume resistivity is $5\times10^{9}$ Ω·cm.

Here, it is desirable that the resistivity of the intermediate transfer belt 110 in the configuration of the present exemplary embodiment is set to be in the following range. The electric resistance of the base layer 110*a*, that is, the surface resistivity measured from the outer circumferential surface side of the intermediate transfer belt 110 is desirably set to be in a range of $5.0\times10^{8}\Omega/\square$ to $1.0\times10^{12}\Omega/\square$, and more desirably set to be in a range of $1.0\times10^{9.5}\Omega/\square$ to $1.0\times10^{11}\Omega/\square$. A range of the surface resistivity of the inner circumferential surface side is desirably $1.0\times10^{7}\Omega/\square$ or less and more desirably $1.0\times10^{6}\Omega/\square$ or less. A range of the volume resistivity thereof is desirably $5.0\times10^{8}$ Ω·cm to $8.0\times10^{11}$ Ω·cm.

The volume resistivity and the surface resistivity of the intermediate transfer belt 110 are measured by using Hiresta-UP (MCP-HT450) manufactured by Mitsubishi Chemical Corporation in a measurement environment of a temperature of 23° C. and a humidity of 50%. The volume resistivity is measured by using a ring probe of type UR (Model: MCP-HTP12) under a condition that the probe is brought into contact with the outer circumferential surface of the intermediate transfer belt 110 at an applied voltage of 100 V and a measurement time of 10 seconds. The surface resistivity is measured by using a ring probe of type UR100 (Model: MCP-HTP16) under a condition of an applied voltage of 100 V and a measurement time of 10 seconds for the outer circumferential surface side and an applied voltage of 10 V and a measurement time of 10 seconds for the inner circumferential surface side. The surface resistivity of the inner circumferential surface side of the intermediate transfer belt 110 is measured by making the probe contact with the inner surface layer 110*b* side and the surface resistivity of the outer circumferential surface side of the intermediate transfer belt 110 is measured by making the probe contact with the base layer 110*a* side.

Exemplary Embodiment 3

Though the carbon black is added as the coloring agent in the exemplary embodiment 2, the carbon black is an aggregate of particles having a diameter of 3 nm to 500 nm and the transmittance of the infrared light changes depending on the particle diameter or a structure of the aggregate. As the particle diameter decreases, the transmittance of the infrared light tends to be reduced, but dispersibility of the carbon black tends to be lowered and the transmittance may have a variation. When the structure of the aggregate is enlarged, the dispersibility tends to be enhanced to reduce the variation of the transmittance, whereas the transmittance of the infrared light tends to be increased. In a case where the carbon black is used as the coloring agent, by increasing the addition amount of the carbon black, it is possible to achieve both reduction in the transmittance of the infrared light and suppression of the variation of the transmittance.

Thus, an exemplary embodiment 3 is characterized in that carbon nanotube is added to an inner surface layer 210*b* as a coloring agent capable of reducing the transmittance of the infrared light even when an addition amount is smaller. Note that, the configuration of the present exemplary embodiment is almost the same as that of the exemplary embodiment 1 except for that the carbon nanotube is used as the coloring agent of the inner surface layer 210*b*. Thus, hereinafter, a part common to that of the exemplary embodiment 1 will be given the same reference sign and description thereof will be omitted.

In the present exemplary embodiment, carbon nanotube having a typical cylindrical structure in which carbon six-membered ring structures are connected is dispersed in polyurethane that is a substrate of the inner surface layer 210*b* of an intermediate transfer belt 210. By using the carbon nanotube having the cylindrical structure as the coloring agent, the infrared light transmitted through a base layer 210*a* of the intermediate transfer belt 210 is repeatedly subjected to reflection and attenuation in the cylindrical structure of the carbon nanotube dispersed in the inner surface layer 210*b* and disappears. Thereby, in the present exemplary embodiment, it is possible to obtain a similar effect to those of the exemplary embodiment 1 and the exemplary embodiment 2 and also possible to achieve the intermediate transfer belt 210 that has a lowered transmission property of the infrared light with a reduced addition amount of the coloring agent.

Exemplary Embodiment 4

Figure 15A:
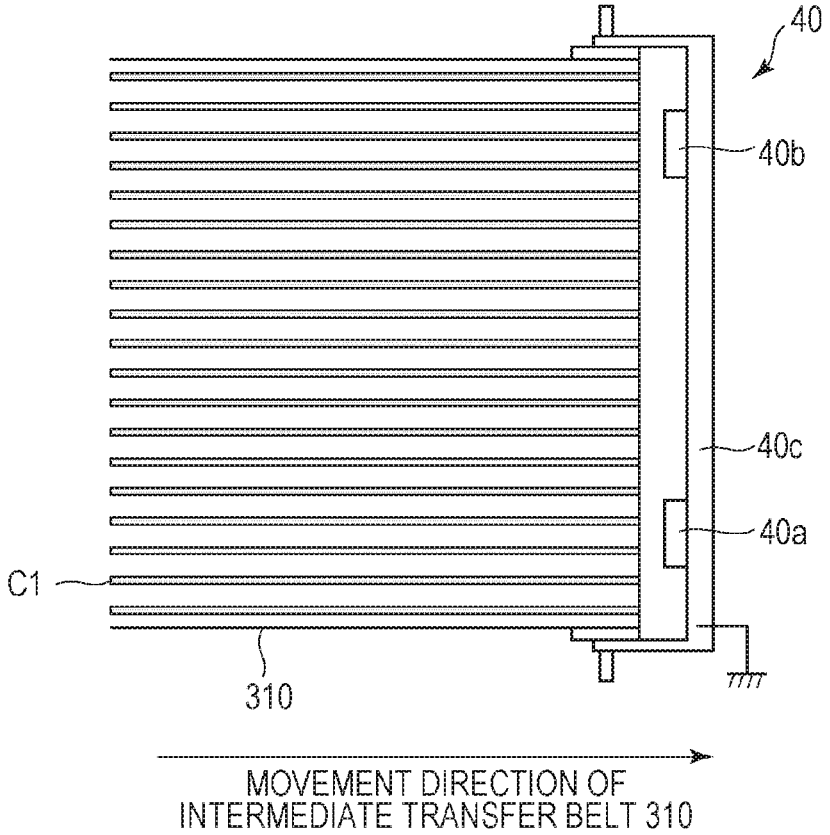
FIGS. 15A and 15B are schematic views of a configuration of an intermediate transfer belt, according to one or more embodiment of the subject disclosure.
Figure 15B:
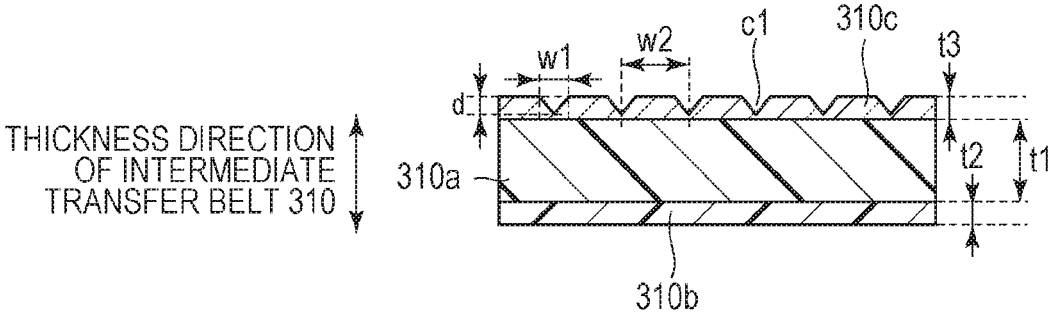

The intermediate transfer belt 110 that has the base layer 110*a* and the inner surface layer 110*b* has been described in the exemplary embodiment 2. On the other hand, as illustrated in FIGS. 15A and 15B, an intermediate transfer belt 310 of an exemplary embodiment 4 is different from that of the exemplary embodiment 1 in terms of including a base layer 310*a*, an inner surface layer 310*b*, and a surface layer 310*c* in which grooves are formed in a movement direction of the intermediate transfer belt 310. FIG. 15A is a schematic view of a configuration of the intermediate transfer belt 310 and FIG. 15B is a schematic sectional view of the intermediate transfer belt 310 as viewed from the movement direction of the intermediate transfer belt 310. Note that, the configuration of the present exemplary embodiment is almost the same as that of the exemplary embodiment 1 except for that the surface layer 310*c* is provided. Thus, hereinafter, a part common to that of the exemplary embodiment 1 will be given the same reference sign and description thereof will be omitted.

As illustrated in FIG. 1, the cleaning blade 16*a* is brought into pressure contact with the intermediate transfer belt 310 from a counter direction to the movement direction of the intermediate transfer belt 10. Thus, in a case where a friction coefficient of a part where the intermediate transfer belt 310 is brought into pressure contact with the cleaning blade 16*a* is large, it is concerned that the cleaning blade 16*a* is turned over or worn due to repetitive usage. When the wear is caused, slipping-through of toner is generated starting from the worn part so that cleaning failure may occur.

Thus, in the present exemplary embodiment, as illustrated in FIGS. 15A and 15B, in order to suppress the occurrence of the cleaning failure, the surface layer 310*c* (third layer) in which grooves c1 are formed along the movement direction of the intermediate transfer belt 310 is provided on a surface of the intermediate transfer belt 310. By providing the surface layer 310*c* having the grooves c1, an area where the cleaning blade 16*a* contacts the intermediate transfer belt 310 is reduced, so that the friction coefficient between the intermediate transfer belt 310 and the cleaning blade 16*a* is able to be reduced. As a result, it is possible to improve cleaning performance of the image forming apparatus 100.

[Explanation of Intermediate Transfer Belt]

As illustrated in FIG. 15B, the intermediate transfer belt 310 of the present exemplary embodiment is configured by three layers in a thickness direction. Configurations and forming methods of the base layer 310*a* and the inner surface layer 310*b* are similar to those of the exemplary embodiment 1. Moreover, as a coloring agent added to the inner surface layer 310*b*, a phthalocyanine-based dye colorant, carbon black, carbon nanotube, or the like is usable. In the present exemplary embodiment, 10 mass % of carbon black is added and the surface resistivity of the inner surface layer 310*b* is $1.0\times10^{6}\Omega/\square$. Note that, desirable ranges of the electric resistances of the base layer 310*a* and the inner surface layer 310*b* of the intermediate transfer belt 310 in the present exemplary embodiment are similar to the ranges of the exemplary embodiment 2, so that description thereof will be omitted.

The surface layer 310*c* is a transparent layer with a thickness of about 2 μm, which is obtained by adding a resistance adjusting agent and a surface lubricant to an outer circumferential surface side of the base layer 310*a* by using acrylic resin as a substrate and which has higher light transmittance than that of the base layer 310*a*. Note that, antinomy dope is used as the resistance adjusting agent and polytetrafluoroethylene (hereinafter, referred to as PTFE) is used as the surface lubricant. On the surface of the surface layer 310*c*, grooves c are periodically formed at a predetermined interval in a width direction of the intermediate transfer belt 310. As illustrated in FIG. 15B, the groves c1 are formed by a surface treatment so that a groove width w1 is 2 μm, a groove depth d is 1 μm, and a groove pitch w2 which is an interval between grooves is 20 μm.

As the groove pitch w2 is wider, the area where the cleaning blade 16*a* contacts the intermediate transfer belt 310 is increased. In such a case, toner remining on the intermediate transfer belt 310 is difficult to pass through the cleaning blade 16*a*, whereas the cleaning blade 16*a* is easily worn in a part where the cleaning blade 16*a* contacts the intermediate transfer belt 310. On the other hand, as the groove pitch w2 is narrower, the area where the cleaning blade 16*a* contacts the intermediate transfer belt 310 is reduced and wear of the cleaning blade 16*a* in the part where the cleaning blade 16*a* contacts the intermediate transfer belt 310 is suppressed. In such a case, however, cleaning failure is easily generated when the toner remining on the intermediate transfer belt 310 passes through the part where the cleaning blade 16*a* contacts the intermediate transfer belt 310. Due to the foregoing reasons, in consideration of slipping-through of the toner remaining on the intermediate transfer belt 310 and wearability of the cleaning blade 16*a*, the groove pitch w2 is desirably in a range of 3 μm to 50 μm in the configuration of the present exemplary embodiment.

Figure 16:
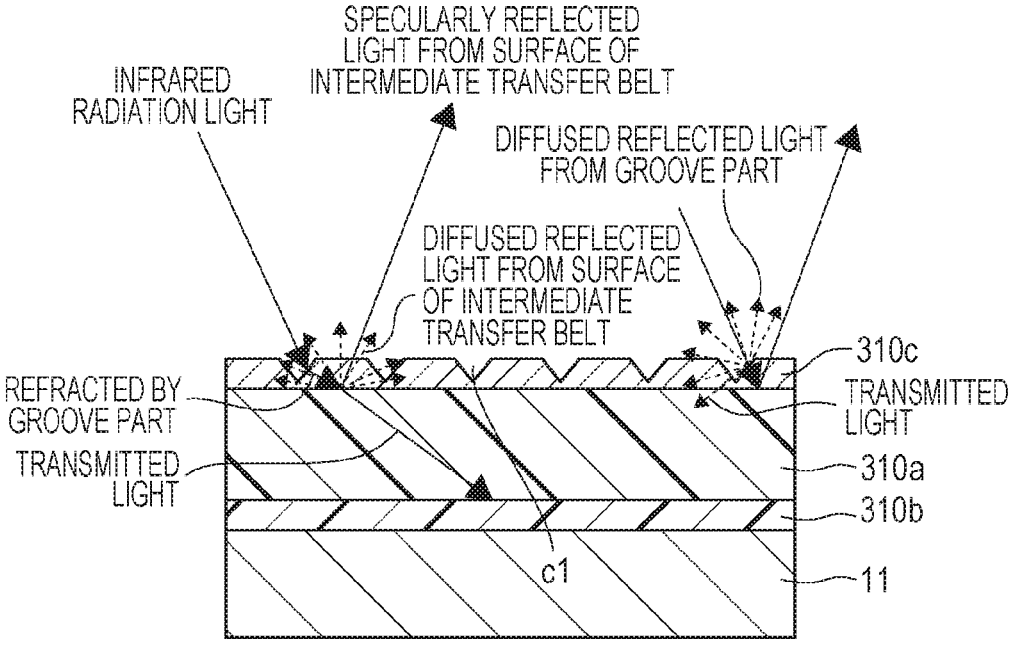
FIG. 16 is a schematic view of reflected light from the intermediate transfer belt, according to one or more embodiment of the subject disclosure.

In a case where a groove shape is formed in the surface layer 310*c* as in the intermediate transfer belt 310, radiation light radiated from the detection unit 40 is also reflected by a side surface of a groove c1. FIG. 16 illustrates how the infrared light radiated from the detection unit 40 to the intermediate transfer belt of the present exemplary embodiment is reflected. In the present exemplary embodiment, diffused reflected light from the groove c1, specularly-reflected light that is refracted by the surface layer 310*c*, and the like are added in addition to the specularly-reflected light and the diffused reflected light which are described in the exemplary embodiment 1, so that reflected light received by the light receiving element 43*a* tends to be increased.

Figure 17A:
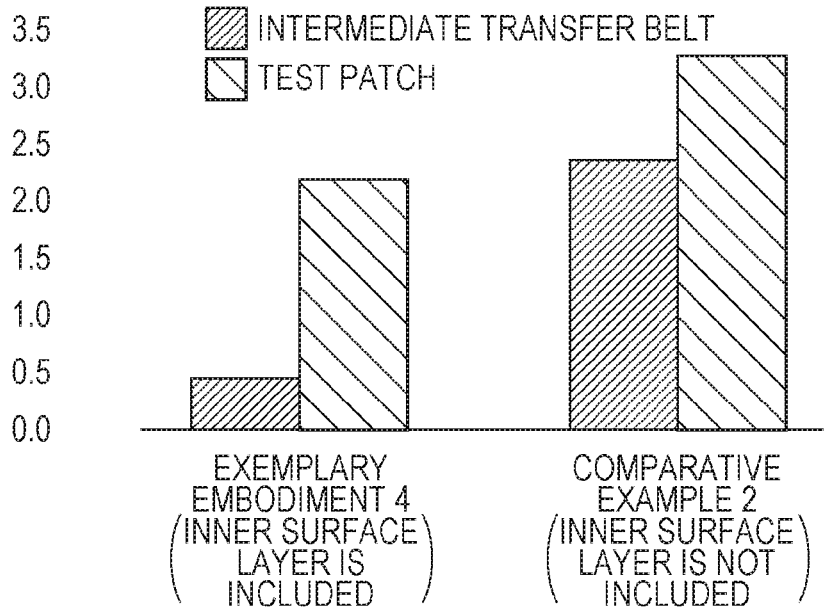
FIGS. 17A and 17B are graphs each indicating a detection result by the detection unit, according to one or more embodiment of the subject disclosure and a comparative example 2.
Figure 17B:
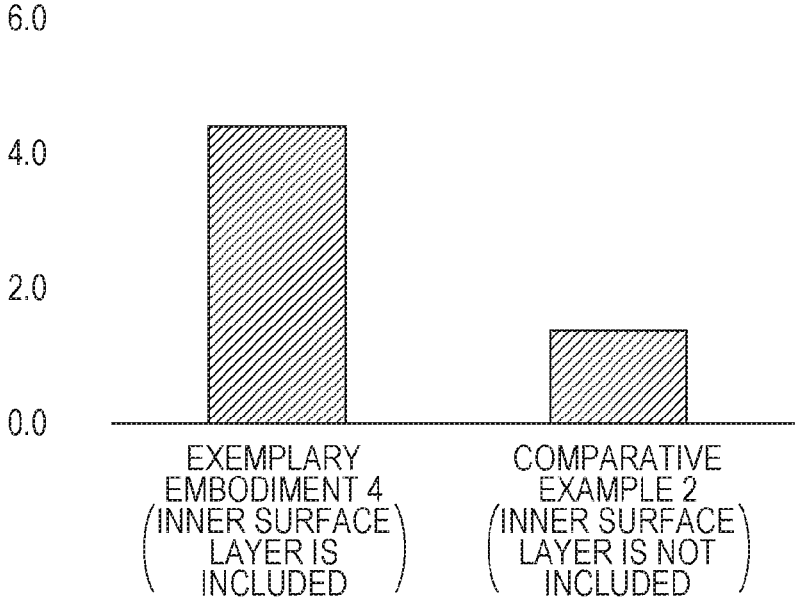

FIG. 17A illustrates a result obtained by, when each of intermediate transfer belts of the present exemplary embodiment and a comparative example 2 are used, detecting by the light receiving element 43*a* diffused reflected light from the surface of the intermediate transfer belt and diffused reflected light from a test patch formed on the intermediate transfer belt. FIG. 17B illustrates a ratio obtained by dividing a detection output of the test patch by a detection output of the surface of the intermediate transfer belt in the present exemplary embodiment and the comparative example 2 on the basis of the detection result of FIG. 17A and illustrates an index of the dynamic range. Note that, the intermediate transfer belt of the comparative example 2 has a configuration in which the inner surface layer 310*b* in the intermediate transfer belt 310 of the present exemplary embodiment is not included but only layers corresponding to the base layer 310*a* and the surface layer 310*c* are included.

As illustrated in FIG. 17A, in the configuration of the present exemplary embodiment, the detection result of the diffused reflected light from the surface of the intermediate transfer belt 310, which is obtained by the light receiving element 43*a*, is 0.5 V. The result is obtained by detecting diffused reflected light generated at the groove c1 of the surface layer 310*c* and specularly-reflected light refracted by the groove c1 part in addition to the diffused reflected light from the base layer 310*a* of the intermediate transfer belt 310. Similarly to the exemplary embodiment 1, a part of the infrared light radiated from the light emitting element 41*a* is transmitted through the base layer 310*a* and then absorbed by the inner surface layer 310*b*.

On the other hand, in the configuration of the comparative example 2, the detection result of the diffused reflected light from the surface of the intermediate transfer belt is 2.4 V and indicates a value higher than that of the present exemplary embodiment. This is because not only the diffused reflected light that is reflected by the surface of the intermediate transfer belt, the diffused reflected light that is generated at the groove part of the surface layer, and the specularly-reflected light that is refracted by the groove part but also a part of the infrared light transmitted through the intermediate transfer belt is diffused and reflected by the surface of the support roller 11 in the configuration of the comparative example 2.

As illustrated in FIG. 17A, in the configuration of the present exemplary embodiment, the detection result of the diffused reflected light from the test patch, which is obtained by the light receiving element 43*a*, is 2.1 V. On the other hand, in the configuration of the comparative example 2, the detection result of the diffused reflected light from the test patch is 3.3 V and indicates a value higher than that of the present exemplary embodiment. This is because, in the configuration of the comparative example 2 in which the inner surface layer 310*b* is not included, not only the diffused reflected light that is reflected by the test patch and the like but also a part of the infrared light transmitted through the test patch and the intermediate transfer belt is diffused and reflected by the surface of the support roller 11.

As illustrated in FIG. 17B, in the configuration of the present exemplary embodiment, a value of the dynamic range is 4.4. According to the result, similarly to the exemplary embodiment 1, the correction control of the image formation condition is able to be performed stably in the configuration of the present exemplary embodiment regardless of disturbance such as deterioration of the intermediate transfer belt 310 over time or contamination of each of the sensors of the detection unit 40. On the other hand, in the configuration of the comparative example 2, the value of the dynamic range is 1.7 and indicates a value lower than that of the present exemplary embodiment. That is, when the intermediate transfer belt of the comparative example 2 is used, there is a possibility that a sufficient dynamic range is not able to be secured and the correction control of the image formation condition is not able to be performed stably depending on disturbance such as deterioration of the intermediate transfer belt over time or contamination of the sensor.

As described above, according to the present embodiment, even when the dynamic range by the diffused reflected light from the surface layer 310*c* is reduced due to the grooves c1 formed in the surface layer 310*c* of the intermediate transfer belt 310, the correction control is able to be stably performed by providing the inner surface layer 310*b*. Thus, the configuration of the present exemplary embodiment is also able to obtain a similar effect to those of the exemplary embodiments 1 to 3. Moreover, by forming the grooves c in the surface layer 310*c*, it is possible to improve cleaning performance of the image forming apparatus 100.

Here, as a method of forming the groove shape in the surface layer 310*c* of the intermediate transfer belt 310, methods of polishing processing, cutting processing, imprint processing, and the like are usable. By appropriately selecting and using a desirable one from among the forming methods, the intermediate transfer belt 310 in which the grooves c are provided in the surface layer 310*c* in the present exemplary embodiment is able to be obtained. Among them, the imprint processing that utilizes a photosetting property of acrylic resin as the substrate of the surface layer 310*c* is suitably performed from a viewpoint of a processing cost and productivity. Without limitation to such imprint processing, the groove shape may be formed by curing the acrylic resin and then applying lapping processing.

The configuration in which the plurality of grooves c1 are periodically formed in the width direction of the intermediate transfer belt 310 has been described in the present exemplary embodiment, but there is no limitation thereto and the grooves c may not be necessarily provided periodically. As long as the grooves c are formed at least in a region on which the infrared light radiated from the light emitting elements 41*a* and 41*b* is fallen, the aforementioned dynamic range by the diffused reflected light from the surface layer 310*c* may be reduced. Then, by providing the intermediate transfer belt 310 in such a case, the effect described in the present exemplary embodiment is able to be sufficiently obtained.

Moreover, the grooves c1 may not be formed continuously over one full circumference of the intermediate transfer belt 310 along the movement direction of the intermediate transfer belt 310 and may be formed discontinuously at a halfway point. That is, the grooves c may be intermittently formed over one full circumference of the intermediate transfer belt 310. The grooves c may extend along a direction intersecting with the width direction orthogonal to the movement direction of the intermediate transfer belt 310 and may be formed in a state of having an angle with respect to the movement direction of the intermediate transfer belt 310. In order to obtain an effect of reducing a friction coefficient between the intermediate transfer belt 310 and the cleaning blade 16*a*, however, the angle formed by the direction in which the grooves c1 extend with respect to the movement direction of the intermediate transfer belt 310 is desirably 45° or less, and more desirably 10° or less.

Note that, though description has been given for the image forming apparatus 100 of an intermediate transfer system using the intermediate transfer belt has been described in the exemplary embodiments 1 to 4, there is no limitation thereto and the effect described above is also able to be achieved by an image forming apparatus of a direct transfer system that has a conveyance belt which conveys the transfer material P.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-068245, filed Mar. 30, 2018 and No. 2019-019539 filed Feb. 6, 2019, which are hereby incorporated by reference herein in their entirety.

What is claimed is:

1. An image forming apparatus comprising:

an image bearing member configured to bear a toner image;

a movable belt configured to contact the image bearing member;

a stretching member which is configured to stretch the belt, and which is provided with a metal member;

a detection unit which is arranged so as to face the metal member of the stretching member via the belt, and which is configured to detect reflected light from the belt and a detection toner image formed on the belt, when light is radiated to the detection toner image on the belt; and a control unit configured to execute, on a basis of a detection result of the detection unit, correction control of an image formation condition of an image formed by the toner image, wherein the detection unit includes a light emitting element that radiates infrared light to the belt, and a light receiving element that detects reflected light from the belt when the infrared light is radiated from the light emitting element to the belt, wherein the belt includes a first layer that has a first light transmittance, a second layer which is formed on an inner circumferential surface side of the belt and which has a second light transmittance lower than the first light transmittance, and a third layer which is formed on an outer circumferential surface side of belt and which has a third light transmittance higher than the first light transmittance, and the third layer contacts the image bearing member, wherein the first layer is a thickest one among the first layer, the second layer and the third layer, with respect to a thickness direction of the belt, and an ion conductive agent is added to the first layer, wherein the detection unit detects the reflected light in a state where the third layer, the first layer, the second layer and the metal member are arranged in order in the thickness direction and the second layer contacts a surface of the metal member, and wherein the second light transmittance is 7.5% or less.

2. The image forming apparatus according to claim 1, further comprising:

a cleaning member configured to contact with the third layer in a counter direction with respect to a movement direction of the belt and collects toner remaining on the belt, wherein at a surface where the third layer is brought into contact with the cleaning member of the third layer, a plurality of grooves are formed along a movement direction of the belt.

3. The image forming apparatus according to claim 2, wherein the grooves are periodically formed in a width direction intersecting with the movement direction.

4. The image forming apparatus according to claim 3, wherein the plurality of grooves are periodically formed at a predetermined interval and a range of the predetermined interval is 3 μm to 50 μm.

5. The image forming apparatus according to claim 1, wherein an electric resistance value of a surface resistivity of the belt measured from an inner circumferential surface side is lower than that of a surface resistivity of the belt measured from an outer circumferential surface side.

6. The image forming apparatus according to claim 5, wherein the second layer is a layer to which carbon black is added.

7. The image forming apparatus according to claim 5, wherein the second layer is a layer to which carbon nanotube is added.

8. The image forming apparatus according to claim 1, wherein the second layer is a layer to which a phthalocyanine-based dye colorant is added.

9. The image forming apparatus according to claim 1, wherein the detection unit includes a light emitting element which radiates infrared light to the belt and a light receiving element which receives the infrared light reflected by the belt, and the second layer is formed only in a region of one full circumference of the belt at a position facing the detection unit in a movement direction of the belt.

10. The image forming apparatus according to claim 9, wherein the control unit executes the correction control on a basis of reflected light from the belt, which is detected by the light receiving element, and reflected light from the detection toner image, which is detected by the light receiving element, when the infrared light is radiated from the light emitting element to the belt and the detection toner image.

11. The image forming apparatus according to claim 1, wherein the detection unit includes a first detection member and a second detection member that are arranged so as to be opposite to each other across a center line of the belt in a width direction intersecting with a movement direction of the belt.

12. The image forming apparatus according to claim 11, wherein the first detection member includes a light emitting element that radiates infrared light to the belt, a light receiving element that detects specularly-reflected light from the belt when the infrared light is radiated from the light emitting element to the belt, and a light receiving element that detects diffused reflected light from the belt, and the second detection member includes a light emitting element that radiates infrared light to the belt and a light receiving element that detects diffused reflected light from the belt when the infrared light is radiated from the light emitting element to the belt, and does not include a light receiving element that detects specularly-reflected light from the belt.

13. The image forming apparatus according to claim 11, wherein the first detection member includes a light emitting element that radiates infrared light to the belt, a light receiving element that detects specularly-reflected light from the belt when the infrared light is radiated from the light emitting element to the belt, and a light receiving element that detects diffused reflected light from the belt, and the second detection member includes a light emitting element that radiates infrared light to the belt and a light receiving element that detects specularly-reflected light from the belt when the infrared light is radiated from the light emitting element to the belt, and does not include a light receiving element that detects diffused reflected light from the belt.

14. The image forming apparatus according to claim 1, wherein the belt is an intermediate transfer belt, and the toner image borne by the image bearing member is primarily-transferred from the image bearing member to the intermediate transfer belt and then secondarily-transferred from the intermediate transfer belt to a transfer material.

15. The image forming apparatus according to claim 1, wherein the belt is a conveyance belt that conveys a transfer material and the toner image borne by the image bearing member is transferred to the transfer material conveyed by the conveyance belt.

16. An endless belt comprising:

a first layer that has a first light transmittance, a second layer, which is formed on an inner circumferential surface side of the belt in a state of using an image forming apparatus, and which has a second light transmittance lower than the first light transmittance, and a third layer which is formed on an outer circumferential surface side of belt in the state of using, and which has a third light transmittance higher than the first light transmittance, wherein the first layer is a thickest one among the first layer, the second layer and the third layer, with respect to a thickness direction of the belt, and an ion conductive agent is added to the first layer, wherein the third layer has a plurality of groves, which is formed on the outer circumferential surface of the belt, and which is formed along a movement direction of belt, in the state of using, and wherein the second light transmittance is 7.5% or less.

* * * * *